US007080690B2

(12) United States Patent
Reitz

(10) Patent No.: US 7,080,690 B2
(45) Date of Patent: Jul. 25, 2006

(54) METHOD AND APPARATUS USING TRACTION SEAL FLUID DISPLACEMENT DEVICE FOR PUMPING WELLS

(76) Inventor: Donald D. Reitz, 7484 East Cedar Ave., Denver, CO (US) 80230

( * ) Notice: Subject to any disclaimer, the term of this patent is extended or adjusted under 35 U.S.C. 154(b) by 55 days.

(21) Appl. No.: 10/456,614

(22) Filed: Jun. 6, 2003

(65) Prior Publication Data

US 2004/0244991 A1 Dec. 9, 2004

(51) Int. Cl.
*E21B 43/00* (2006.01)

(52) U.S. Cl. ..... 166/372; 166/369; 166/68

(58) Field of Classification Search ..... 166/372, 166/369, 68

See application file for complete search history.

(56) References Cited

U.S. PATENT DOCUMENTS

| | | | | |
|---|---|---|---|---|
| 1,853,269 | A | | 4/1932 | Harris |
| 2,016,433 | A | | 10/1935 | Humason |
| 2,142,773 | A | | 1/1939 | Athey |
| 2,698,581 | A | | 1/1955 | Maier |
| 2,941,537 | A | | 6/1960 | Watkins |
| 2,951,255 | A | * | 9/1960 | Ver Nooy ..... 15/104.061 |
| 3,021,793 | A | | 2/1962 | Bolstad |
| 3,090,316 | A | | 5/1963 | Montgomery |
| 3,884,299 | A | | 5/1975 | McCarter et al. |
| 3,894,583 | A | | 7/1975 | Morgan |
| 3,941,510 | A | | 3/1976 | Morgan |
| 3,991,825 | A | | 11/1976 | Morgan |
| 4,036,254 | A | | 7/1977 | Alcalde Pecero |
| 4,216,026 | A | | 8/1980 | Scott |
| 4,416,703 | A | | 11/1983 | Scott |
| 4,502,843 | A | | 3/1985 | Martin |
| 4,509,599 | A | | 4/1985 | Chenoweth et al. |
| 4,527,633 | A | | 7/1985 | McLaughlin et al. |
| 4,653,989 | A | | 3/1987 | Mason |
| 4,676,310 | A | | 6/1987 | Scherbatskoy et al. |
| 4,708,595 | A | | 11/1987 | Maloney et al. |
| 4,711,306 | A | | 12/1987 | Bobo |
| 4,741,673 | A | | 5/1988 | Jubb |
| 4,768,595 | A | | 9/1988 | Smith |
| 4,844,156 | A | | 7/1989 | Hesh |

(Continued)

FOREIGN PATENT DOCUMENTS

RU 570697 8/1977

OTHER PUBLICATIONS

Kermit Brown, The Technology of Artificial Life Methods, vol. 2, pp. 125-131, 1977.

(Continued)

*Primary Examiner*—David Bagnell
*Assistant Examiner*—Shane Bomar
(74) *Attorney, Agent, or Firm*—John R. Ley

(57) ABSTRACT

Liquid is lifted from a well by a traction seal fluid displacement device which is moveably positioned within the production tubing, and which maintains a seal during movement. The traction seal device comprises a resilient flexible toroid shaped structure within outside surface which contacts the inner sidewall of the production tubing and an inside surface which contacts itself to establish seals to these contact points as the outside surface rolls in essentially frictionless contact with in the production tubing. The toroid shaped structure is moved within the production chamber by applying a pressure differential across it. The pressure source is preferably natural gas at formation pressure.

50 Claims, 13 Drawing Sheets

U.S. PATENT DOCUMENTS

| | | | | |
|---|---|---|---|---|
| 4,923,372 | A | 5/1990 | Ferguson et al. | |
| 5,006,046 | A | 4/1991 | Buckman et al. | |
| 5,069,285 | A | 12/1991 | Nuckols | |
| 5,208,936 | A * | 5/1993 | Campbell | 15/104.061 |
| 5,211,242 | A | 5/1993 | Coleman et al. | |
| 5,374,163 | A | 12/1994 | Jaikaran | |
| 5,407,010 | A | 4/1995 | Herschberger | |
| 5,417,281 | A | 5/1995 | Wood et al. | |
| 5,431,222 | A | 7/1995 | Bustamante | |
| 5,488,993 | A | 2/1996 | Herschberger | |
| 5,522,463 | A | 6/1996 | Barbee | |
| 5,544,706 | A | 8/1996 | Reed | |
| 5,611,397 | A | 3/1997 | Wood | |
| 5,611,671 | A | 3/1997 | Tripp, Jr. | |
| 5,655,605 | A | 8/1997 | Matthews | |
| 5,671,813 | A | 9/1997 | Lima | |
| 5,911,278 | A | 6/1999 | Reitz | |
| 6,045,335 | A * | 4/2000 | Dinning | 417/59 |
| 6,148,923 | A * | 11/2000 | Casey | 166/372 |
| 6,190,090 | B1 * | 2/2001 | Campbell et al. | 405/211.1 |
| 6,293,340 | B1 * | 9/2001 | Wu | 166/105.5 |
| 6,637,510 | B1 * | 10/2003 | Lee | 166/108 |
| 6,688,385 | B1 * | 2/2004 | Moe | 166/53 |
| 6,746,213 | B1 * | 6/2004 | Giacomino | 417/56 |
| 6,851,480 | B1 * | 2/2005 | Swoyer et al. | 166/372 |
| 2002/0007953 | A1 | 1/2002 | Liknes | |

OTHER PUBLICATIONS

E.E. DeMoss, 4 New Ways to Reduce Artificial Lift Expense, World Oil, pp. 63 and 64, May 1973.

H.W. Winkler et al., Down-Hole Chambers Increase Gas-Life Efficiency, The Petroleum Engineer, part 1—Jun. 1956; part 2—Aug. 1956.

H.W. Winkler et al., Chamber Design, CAMCO Gas Lift Manual, Chapter VII, pp. 7-001-7-015, 1962.

John T. Dewan, et al., Lifting of Heavy Oil with Inert-Gas-Operated Chamber Pumps, SPE 9913, pp. 277-285 plus illustrations.

Steve B. Coleman et al., A New Look at Predicting Gas-Well Load-Up, JPT, Mar., 1991.

Steve B. Coleman et al., Understanding Gas-Well, Load-Up Behavior, JPT, Mar., 1991.

E.E. DeMoss et al., *Liquid Removal from Gas Wells—Gas Lifting with Reservoir Gas*, Apr. 1968.

* cited by examiner

A
88
70
82
84
86
74
D
H
64
I
92
62
30
78
90
40
80
C
G
68
F
B
E
C

METHOD AND APPARATUS USING TRACTION SEAL FLUID DISPLACEMENT DEVICE FOR PUMPING WELLS

This invention relates to pumping fluids from a hydrocarbons-producing well formed in the earth. More particularly, the present invention relates to a new and improved method and apparatus that uses a rolling traction seal fluid displacement device, such as an endless, self-contained plastic fluid plug, in connection with gas pressures within the well to lift liquid from the well to thereby produce the hydrocarbons from the well.

BACKGROUND OF THE INVENTION

Hydrocarbons, principally oil and natural gas, are produced by drilling a well or borehole from the earth surface to a subterranean formation or zone which contains the hydrocarbons, and then flowing the hydrocarbons up the well to the earth surface. Natural formation pressure forces the hydrocarbons from the surrounding hydrocarbons-bearing zone into the well bore. Since water is usually present in most subterranean formations, water is also typically pushed into the well bore along with the hydrocarbons.

In the early stages of a producing well, there may be sufficient natural formation pressure to force the liquid and gas entirely to the earth's surface without assistance. In later stages of a well's life, the diminished natural formation pressure may be effective only to move liquid partially up the well bore. At that point, it becomes necessary to install pumping equipment in the well to lift the liquid from the well. Removing the liquid from the well reduces a counterbalancing hydrostatic effect created by the accumulated column of liquid, thereby allowing the natural formation pressure to continue to push additional amounts of liquid and gas into the well. Even in wells with low natural formation pressure, oil may drain into the well. In these cases, it becomes necessary to pump the liquid from the well in order to maintain productivity.

There are a variety of different pumps available for use in wells. Each different type of pump has its own relative advantages and disadvantages. In general, however, common disadvantages of all the pumps include a susceptibility to wear and failure as a result of frictional movement, particularly because small particles of sand and other earth materials within the liquid create an abrasive environment that causes the parts to wear and ultimately fail. Moreover, the physical characteristics of the well itself may present certain irregularities which must be accommodated by the pump. For example, the well bore may not be vertical or straight, the pipes or tubes within the well may be of different sizes at different depth locations, and the pipes and tubes may have been deformed from their original geometric shapes as a result of installation and use within the well. A more specific discussion of the different aspects of various pumps illustrates some of these issues.

One type of pump used in hydrocarbons-producing wells is a rod pump. A rod pump uses a series of long connected metal rods that extend from a powered pumping unit at the earth surface down to a piston located at the bottom of a production tube within the well. The rod is driven in upward and downward strokes to move the piston and force liquid up the production tube. The moving parts of the piston wear out, particularly under the influence of sand grain particles carried by the liquids into the well. Rod pumps are usually effective only in relatively shallow or moderate-depth wells which are vertical or are only slightly deviated or curved.

The moving rod may rub against the production tubing in deep, significantly deviated or non-vertical wells. The frictional wear on the parts diminish their usable lifetime and may increase the pumping costs due to frequent repairs.

Another type of pump uses a plunger located in a production tubing to lift the liquid in the production tubing. Gas pressure is introduced below the plunger to cause it to move up the production tube and push liquid in front of it up the production tube to the earth surface. Thereafter, the plunger falls back through the production tube to the well bottom to repeat the process. While plunger lift pumps do not require long mechanical rods, they do require the extra flow control equipment necessary to control the movement of the plunger and regulate the gas and liquid delivered to the earth surface. The plunger must also have an exterior dimension which provides a clearance with the production tubing to reduce friction and to permit the plunger to move past slight non-cylindrical irregularities in the production tubing without being trapped. This clearance dimension reduces the sealing effect necessary to hold the liquid in front of the plunger as it moves up the production tubing. The clearance dimension causes some of the liquid to fall past the plunger back to the bottom of the well, and causes some of the gas pressure which forces the plunger upward to escape around the plunger. Diminished pumping efficiency occurs as a result. Plunger lift pumps also require the production tubing to have a substantial uniform size from the top to the bottom.

A gas pressure lift is another example of a well pump. In general, a gas pressure lift injects pressurized gas into the bottom of the well to force the liquid up a production tubing. The injected gas may froth the liquid by mixing the heavier density liquid with the lighter density gas to reduce the overall density of the lifted material thereby allowing it to be lifted more readily. Alternatively, "slugs" or shortened column lengths of liquid separated by bubble-like spaces of pressurized gas are created to reduce the density of the liquid, and the slugs are lifted to the earth surface. Although gas pressure lifts avoid the problems of friction and wear resulting from using movable mechanical components, gas pressure lifts frequently require the use of many items of auxiliary equipment to control the application of the pressures within the well and also require significant equipment to create the large volumes of gas at the pressures required to lift the liquid.

At some point in the production lifetime of a well, the costs of operating and maintaining the pump are counterbalanced by the diminished amount of hydrocarbons produced by the continually-diminishing formation pressure. For deeper wells, more cost is required to lift the liquid a greater distance to the earth surface. For those wells which require frequent repair because of failed mechanical parts, the point of uneconomic operation is reached while producible amounts of hydrocarbons may still remain in the well. For those deep and other wells which require significant energy expenditures to pump, the point of uneconomic operation may occur earlier in the life of a well. In each case, the hydrocarbons production from a well can be extended if the pump is capable of operating by using less energy under circumstances of reduced requirements for maintenance and repair.

SUMMARY OF THE INVENTION

The present invention makes use of a rolling traction seal fluid displacement device located within a production tubing of a hydrocarbons-producing well to lift liquid up the production tubing and out of the well. The traction seal device is preferably moved up the production tubing by gas at a pressure and volume supplied by the earth formation, thereby significantly reducing the energy costs for pumping the well as a result of using natural energy sources either exclusively or significantly to pump the well. The traction seal device obtains traction against the production tubing and moves with substantially frictionless contact within the production tubing, thereby substantially eliminating or reducing the wear and ultimately the failure created by relative movement-induced friction. The rolling tractive contact of the traction seal device with the production tubing establishes an essentially complete seal within the production tubing and with itself to prevent the liquid above and the gas pressure below the traction seal device from leaking past it and reducing the pumping efficiency. Further still, the traction seal device has an ability to achieve these desirable features while passing through segments of the production tubing that may be irregular in shape, corroded or eroded, or have grooves and small pits, contain buildup, or even change size slightly.

In accordance with these and other significant improvements and advantages, liquid is lifted from a well through a production tubing that has an inner sidewall which defines an interior production chamber, by use of a liquid lifting apparatus which comprises a traction seal device moveably positioned within the production tubing. Liquid may also be lifted from the well by a method which comprises movably positioning a traction seal device within the production tubing, sealing the traction seal device to the inner sidewall to confine the liquid to be lifted within production tubing above the traction seal device, moving the traction seal device within the production chamber, and maintaining the seal across the production tubing at the inner sidewall while moving the traction seal device within the production chamber by rolling an endless portion of the traction seal device in tractive contact with the inner sidewall.

Preferably, the traction seal device rolls in essentially frictionless contact with the inner sidewall of the production tubing which defines the interior production chamber, and the traction seal device is compressed against the inner sidewall while it remains resiliently flexible with the inner sidewall.

A preferred form of the traction seal device comprises a toroid shaped flexible structure having an exterior elastomeric skin defining a cavity within which a viscous fluid material is confined. An outside surface of the toroid shaped structure contacts the inner sidewall and an inside surface of the toroid shaped structure contacts itself. The contact of the outside surface with the inner sidewall and the contact of the inside surface with itself establishes the seal to confine the lifted liquid within the production chamber. The toroid shaped structure rolls during movement of the traction seal device within the production tubing. The elastomeric exterior skin applies compression force on the viscous material to force the outside surface into resilient tractive contact with the inner sidewall and to force the inside surface into resilient contact with itself. The traction seal device moves within the production chamber in response to a difference in pressure on opposite sides of the traction seal device.

In those cases where the well includes a casing which extends into a well bottom at a subterranean zone which contains liquid and gas, the production tubing extends within the casing to the well bottom, and a casing chamber is defined between the casing and the production tubing. Natural formation pressure within the subterranean zone flows the liquid and gas into the casing chamber at the well bottom. The production chamber is in fluid communication with the casing chamber at lower ends of the production tubing and the casing at the well bottom. Under these circumstances, the traction seal device is moved within the production chamber by applying a pressure differential across the traction seal device within the production tubing. The pressure differential is preferably supplied by gas at the natural formation pressure applied within the production tubing below the traction seal device to move the traction seal device upward. The traction seal device is preferably moved downward by gas supplied by the formation pressure but accumulated at the earth surface for the purpose of moving the traction seal device downward. The upper end of the production chamber preferably communicates with a pressure less than the pressure of the gas at the natural formation pressure during upward movement of the traction seal device. Conversely, the upper end of the production chamber communicates with a pressure greater than the pressure of the gas at the natural formation pressure during downward movement of the traction seal device. Gas is preferably produced from the casing chamber upon the traction seal device reaching the upper position within the production tubing and while the device remains at the upper position. Gas is also preferably produced from the casing chamber while the traction seal device is moving downward within the production tubing. Liquid at the well bottom is moved into the production chamber above the traction seal device, preferably by establishing pressure within the production chamber above the traction seal device which is less than the pressure within the casing chamber.

A more complete appreciation of the scope of the present invention and the manner in which it achieves the above-noted and other improvements can be obtained by reference to the following detailed description of presently preferred embodiments taken in connection with the accompanying drawings, which are briefly summarized below, and by reference to the appended claims.

DETAILED DESCRIPTION

Figure 1:
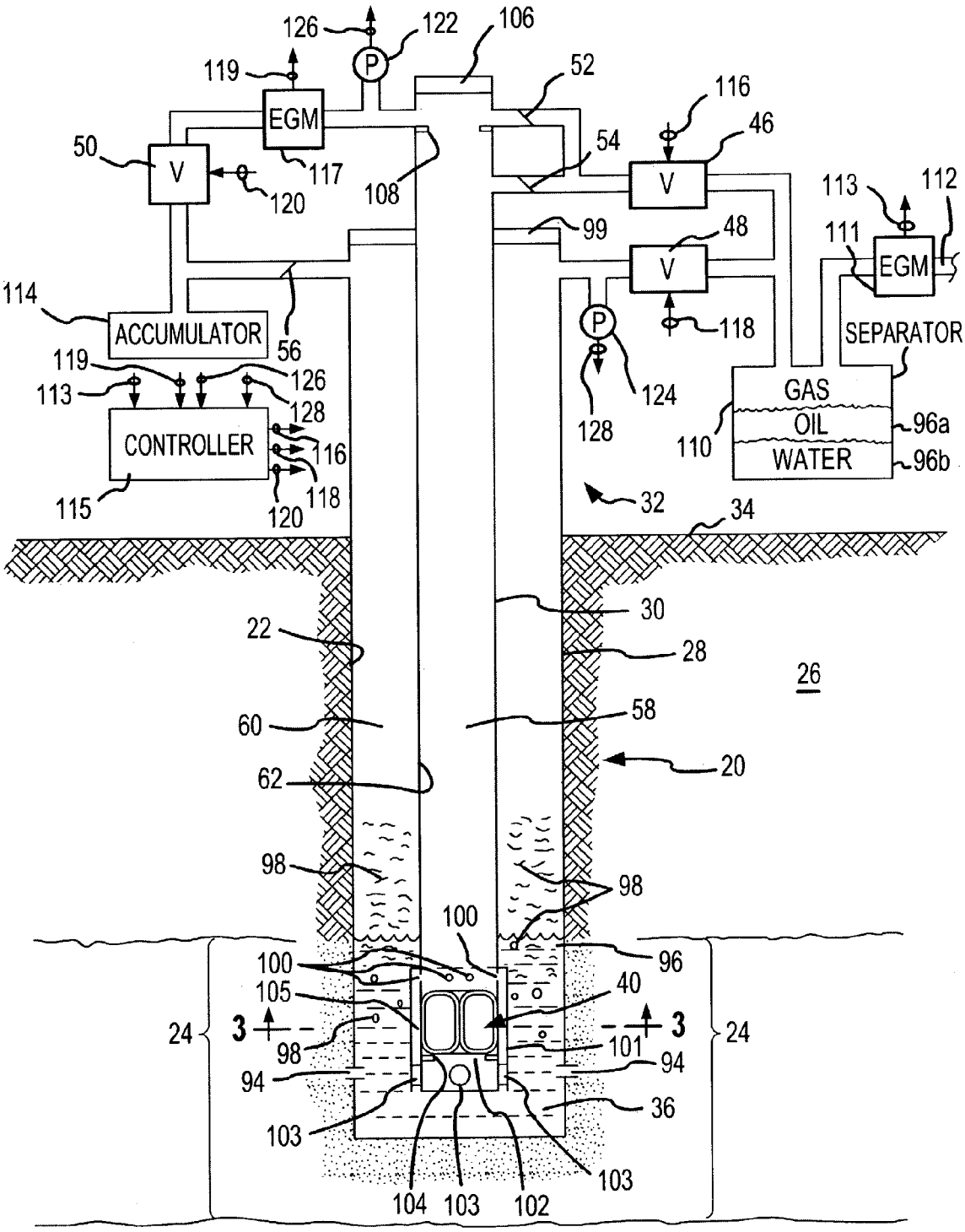
FIG. 1 is a schematic longitudinal cross section view of a hydrocarbons-producing well which uses a traction seal fluid displacement device according to the present invention.

An exemplary hydrocarbons-producing well 20 in which the present invention is used the shown in FIG. 1. The well 20 is formed by a well bore 22 which has been drilled or otherwise formed downward to a sufficient depth to penetrate into a subterranean hydrocarbons-bearing formation or zone 24 of the earth 26. A conventional casing 28 lines the well 20, and a production tubing 30 extends within the casing 28. The casing 28 and the production tubing 30 extend from a well head 32 at the earth surface 34 to near a bottom 36 of the well bore 22 located in the hydrocarbons-bearing zone 24.

An endless rolling traction seal fluid displacement device 40 is positioned within the production tubing 30 and moves between the well bottom 36 and the well head 32 as a result of gas pressure applied within the production tubing 30. Formation pressure at the hydrocarbons-bearing zone 24 normally supplies the gas pressure for moving the traction seal device 40 up and down the production tubing. Conventional chokes or flow control devices such as motor valves (V) 46, 48 and 50, and conventional check valves 52, 54 and 56, located at the well head 32 above the earth surface 34, selectively control the application and influence of the gas pressure in a production chamber 58 of the production tubing 30 and in a casing chamber 60 defined by an annulus between the casing 28 and the production tubing 30.

The traction seal device 40 establishes a fluid tight seal across an interior sidewall 62 of the production tubing 30. The traction seal device 40 also contacts and rolls along the interior sidewall 62 with essentially no friction while maintaining a traction relationship with the production tubing 30 due to the lack of relative movement between the traction seal device 40 and the interior sidewall 62. Gas pressure from the casing chamber 60, which normally originates from the hydrocarbons-bearing zone 24, is applied below the traction seal device 40 to cause the device 40 to move upward in the production tubing 30 from the well bottom 36, and while doing so, push or displace liquid accumulated above the traction seal device 40 to the well head 32. Gas pressure is then applied in the production chamber 58 of the production tubing 30 above the traction seal device 40 to push it back down the production tubing 30 to the well bottom 36, thereby completing one liquid lift cycle and initiating the next subsequent liquid lift cycle.

The liquid lift cycles are repeated to pump liquid from the well. By lifting the liquid out of the well 20, the natural earth formation pressure is available to push more hydrocarbons from the zone 24 into the well so that production of the hydrocarbons can be maintained. To the extent that the liquid lifted from the well includes liquid hydrocarbons such as oil, the hydrocarbons are recovered on a commercial basis. To the extent that the liquid lifted from the well includes water, the water is separated and discarded. Any natural gas which accompanies the liquid is also recovered on a commercial basis. The natural gas which is produced from the casing chamber 60 as a result of removing the liquid is also recovered on a commercial basis.

Significant advantages and improvements arise from using the rolling traction seal device 40 as part of a liquid lift or pumping apparatus. The traction seal device 40 is preferably a jacketed or self-contained plastic fluid plug, the details of which are described in conjunction with FIGS. 2–7.

Figure 2:
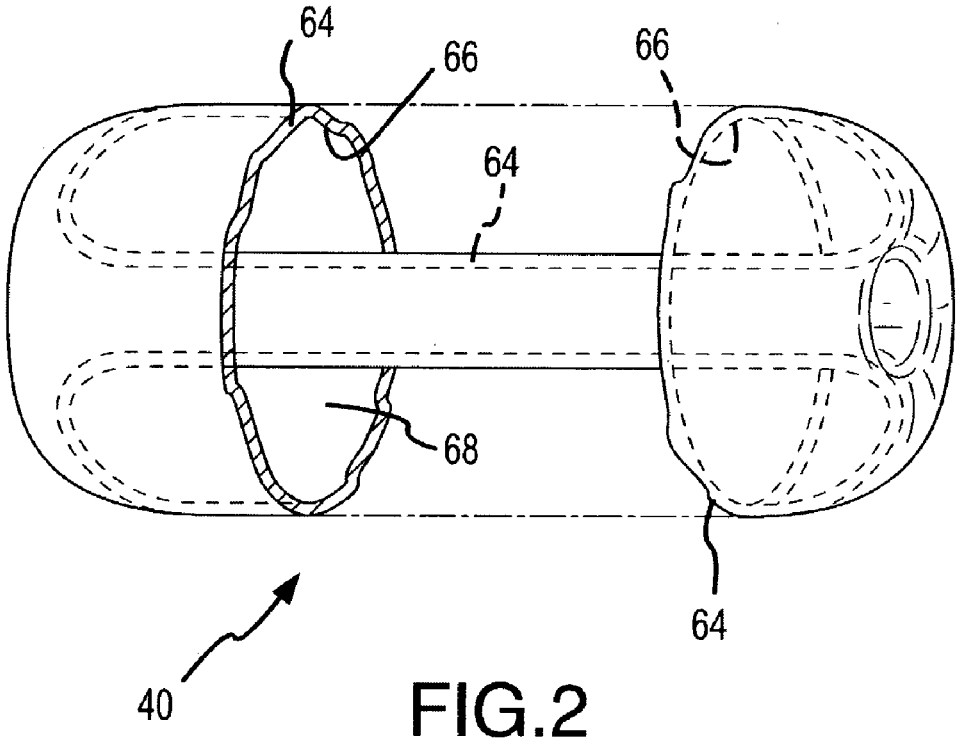
FIG. 2 is a perspective view of the traction seal device used in the well shown in FIG. 1, with a portion broken out to illustrate its internal structure and configuration.
Figure 3:
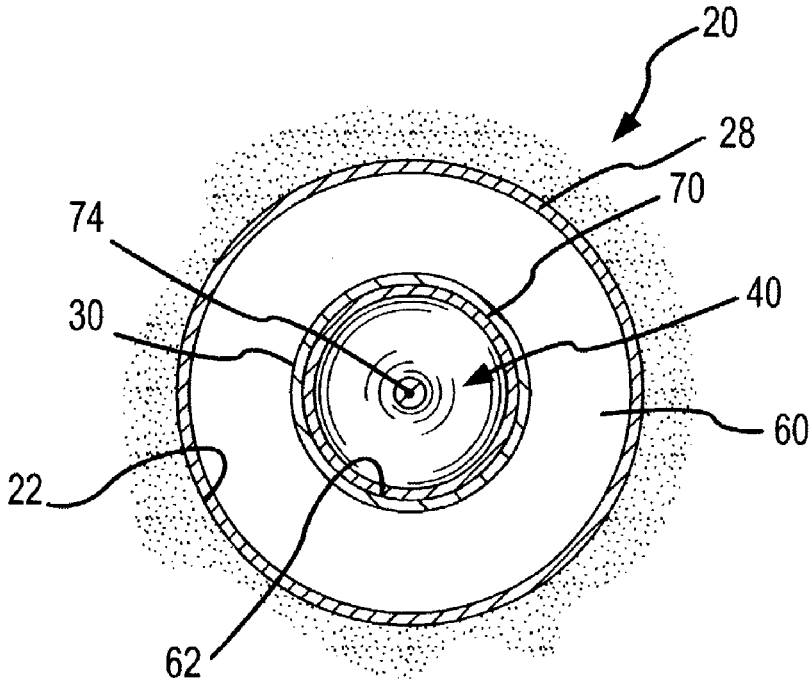
FIG. 3 is an enlarged transverse cross section view taken substantially in the plane of line 3—3 in FIG. 1.

As shown in FIG. 2, the traction seal device 40 is a flexible or plastic structure formed by a flexible outer enclosure or exterior skin 64 which generally assumes the shape of a toroid. The exterior skin 64 is a durable elastomeric material. The exterior skin 64 may be formed from a piece of elastomeric tubing which has had its opposite ends folded exteriorly over the central portion of the tube and then sealed together, as can be understood from FIG. 2. The closed configuration of the exterior skin 64 forms a closed and sealed interior cavity 66 which is filled with a fluid or viscous material 68, such as gel, liquid or slurry. The viscous material 68 may be injected through the exterior skin 64 to fill the interior cavity 66, or confined within the interior cavity 66 when the exterior skin 64 is created in the shape of the toroid. The configuration of the traction seal device 40, its construction and basic characteristics, are conventional.

When the toroid shaped traction seal device 40 is inserted into the production tubing 30, it is radially compressed against the sidewall 62, as shown in FIGS. 3–7. The flexible exterior skin 64 stretches and the viscous material 68 redistributes itself within the interior cavity 66 (FIG. 2) to elongate the traction seal device 40 sufficiently to accommodate the degree of radial compression necessary to fit within the production tubing 30 and to compress itself together at its center. Because the exterior skin 64 is stretched, the exterior skin creates sufficient internal compression against the viscous material 68 to maintain the traction seal device in radial compression against the interior sidewall 62 of the production tubing 30. The flexibility and radial compression causes the traction seal device 40 to conform to the interior sidewall 62 of the production tubing 30.

As shown primarily in FIGS. 4–7, an outside surface 70 of the exterior skin 64 contacts the interior sidewall 62 of the production tubing 30 and forms an exterior seal between the traction seal device 40 and the sidewall 62 at the outside surface 70. In addition, an inside surface 74 of the exterior skin 64 is squeezed into contact with itself at opposing shaped oval portions 78 and 80 to form an interior seal at the center location where the inside surface 74 contacts itself. Because of the radially compressed contact of the outside surface 70 with the interior sidewall 62 of the production tubing 60, and the radially compressed contact of the inside surface 74 with itself, a complete fluid-tight seal is created across the interior sidewall 62 to seal the production chamber 58 at the location of the traction seal device 40.

The complete seal across the interior sidewall 62 is maintained as the traction seal device 40 moves along the production tubing 30. The viscous material 68 within interior cavity 66 (FIG. 2) moves under the influence of gas pressure applied at one end of the traction seal device 40. The gas pressure pushes on the flexible center of the traction seal device and causes it to roll along the interior sidewall 62 of the production tubing 30 while the outside surface 70 maintains sealing and tractive contact with the interior sidewall 62 and while the inside surface 74 maintains sealing contact with itself, thereby establishing and maintaining a movable, essentially-frictionless seal across the interior sidewall 62 of the production tubing 30. This effect is better illustrated in conjunction with the series of four quarter-rotational position views of the traction seal device 40 which are shown in FIGS. 4–7.

As shown in FIGS. 4–7, the generally toroid shaped traction seal device 40 has a left-hand oval portion 78 and a right hand oval portion 80, formed by the exterior skin 64. The left hand oval portion 78 includes a left side exterior wall 82 and a left side interior wall 84. The right hand oval portion 80 includes a right side interior wall 86 and a right side exterior wall 88. In addition, a left hand reference point 90 and a right hand reference point 92 are located on the left-hand and right-hand oval portions 78 and 80, respectively. The reference points 90 and 92 are used to designate and illustrate the rolling movement of the traction seal device 40. Although referenced separately, the walls 82, 84, 86 and 88 are all part of the exterior skin 64 (FIG. 2).

Upward rolling movement of the traction seal device 40 along the interior sidewall 62 of the production tubing 30 is illustrated by the sequence progressing through FIGS. 4–7, in that order. The reference points 90 and 92 illustrate the relative movement, since the shape or configuration of the traction seal device 40 remains essentially the same as it rolls. As the traction seal device 40 moves, the outside surface 70 of the left and right exterior walls 82 and 88 rolls into stationary tractive contact with the interior sidewall 62 of the production tubing 30, thereby creating the exterior seal of the traction seal device 40 with the interior sidewall 62. The exterior seal at the outside surface 70 is essentially frictionless because the exterior walls 82 and 88 roll into tractive contact with the exterior sidewall 62 and remain stationary with respect to the exterior sidewall 62 during movement of the traction seal device 40. Similarly, the inside surface 74 of the left and right interior walls 84 and 86 rolls into stationary contact with itself and creates the interior seal of the traction seal device. The interior viscous material 68 is in sufficient compression to force the outside surface 70 into compressed tractive contact against the sidewall 62 and to force the inside surface 74 into compressive contact with itself.

Figures 4, 5, 6, 7:
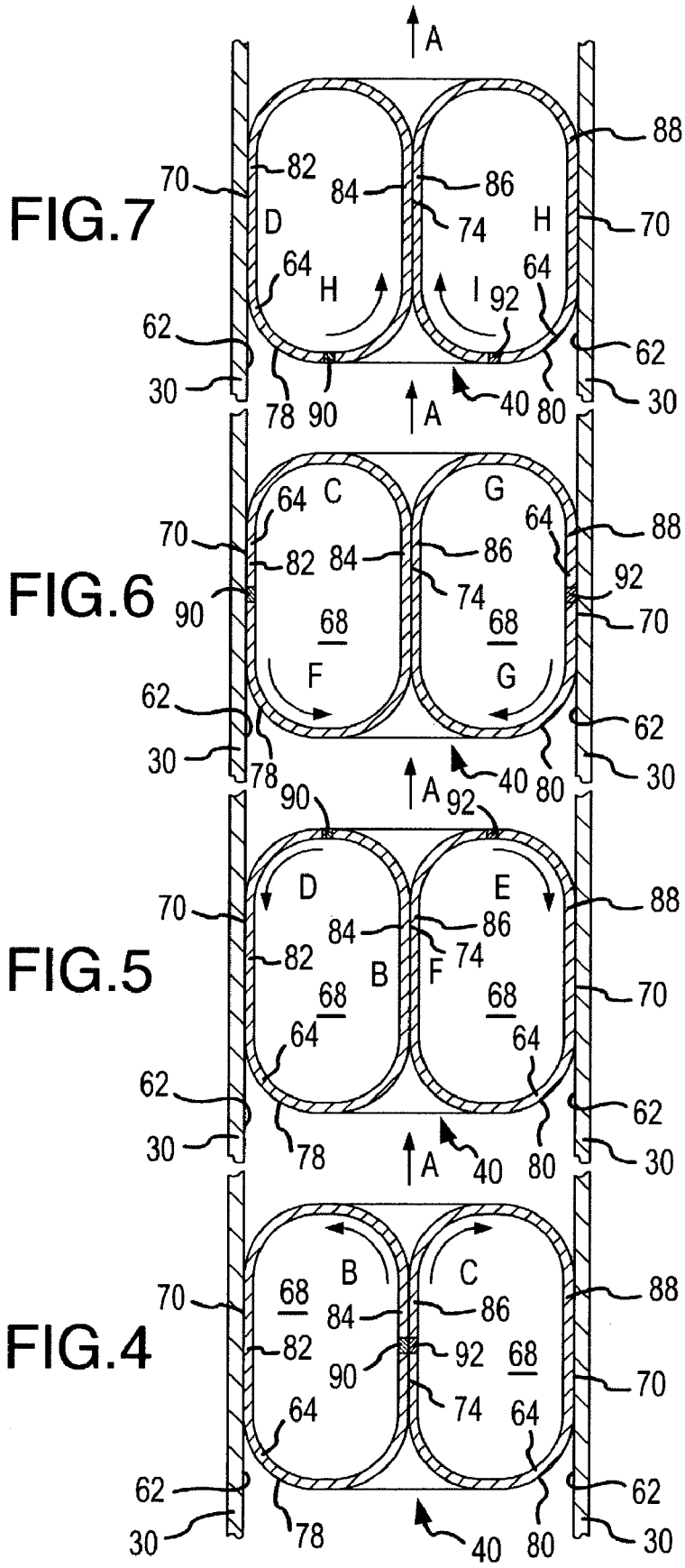
FIGS. 4–7 are enlarged longitudinal cross section views of the traction seal device shown in FIG. 2, located within a production tubing of the well shown in FIG. 1, showing a series of four quarter-rotational intervals occurring during one rotation of the traction seal device during upward movement within the production tubing.

As shown in FIG. 4, the left reference point 90 and the right reference point 92 are adjacent one another at the inside surface 74 of the left and right hand oval portions 78 and 80. As the traction seal device 40 moves up in the production tubing 30 in the direction of arrow A, the left reference point 90 and the right reference point 92 move counterclockwise and clockwise relative to one another in the direction of arrows B and C, respectively, until the reference points 90 and 92 reach top locations shown in FIG. 5. Further upward movement in the direction of arrow A causes left reference point 90 and the right reference point 92 to move counterclockwise and clockwise in the directions of arrows D and E, respectively, until the reference points 90 and 92 are adjacent to the interior sidewall 62 of the production tubing 30, as shown in FIG. 6. At this point, the reference points 90 and 92 are at the outside surface 70 of the traction seal device 40. Further upward movement by the traction seal device 40 in the direction of arrow A causes the left reference point 90 and the right reference point 92 to move counterclockwise and clockwise in the direction of arrows F and G, respectively, until the reference points 90 and 92 reach bottom locations as shown in FIG. 7. Still further upward movement of the traction seal device 40 causes the left reference point 90 and right reference point 92 to move counterclockwise and clockwise in the direction of arrows H and I, respectively, to arrive back at the positions shown in FIG. 4. At this relative movement position, the reference points 90 and 92 have returned to the inside surface 74, and the traction seal device 40 has rolled one complete rotation. During this complete rotation, the outside surface 70 and the inside surface 74 of the exterior skin 64 have maintained a complete seal across the inside sidewall 62 of the production tubing 30, and a seal has been established across the production chamber 58 (FIG. 1) at the location of the traction seal device 40 as it moves up the production tubing 30.

The same sequence shown in FIGS. 4–7 exists during downward movement of the traction seal device, except that the relative movement shown by the points 90 and 92 and the arrows A–I is reversed. Consequently, a complete seal is also maintained across the production chamber in the same manner during downward movement within the production tubing 30.

The materials and the characteristics of the traction seal device 40 are selected to withstand influences to which it is subjected in the well 20. The exterior skin 64 must be resistant to the chemical and other potentially degrading effects of the liquid and gas and other materials found in a typical hydrocarbons-producing well. The exterior skin 64 must maintain its elasticity, flexibility and pliability, and must resist cracking from the rotational movement, under such influences. The exterior skin 64 must have sufficient flexibility and pliability to accommodate the continued expansion and contraction caused by the rolling movement. The exterior skin 64 should also be durable and resistant to puncturing or cutting that might be caused by movement over sharp or discontinuous surfaces within the production tubing, particularly at joints or transitions in size of the production tubing. The viscous material 68 should retain an adequate level of viscosity to permit the rolling motion. The exterior skin 64 and the interior viscous material 68 should also have the capability to withstand relatively high temperatures which exist at the well bottom 36. These characteristics should be maintained over a relatively long usable lifetime.

The liquid which is lifted by using the traction seal device 40 enters the well bottom 36 through casing perforations 94 formed in the casing 28, as shown in FIG. 1. The well casing 28 is generally cylindrical and lines the well bore 22 from the well bottom 36 to the well head 32. The casing 28 maintains the integrity of the well bore 22 so that pieces of the surrounding earth 26 cannot fall into and close off the well 24. The casing 28 also defines and maintains the integrity of the casing chamber 60.

The casing perforations 94 are located at the hydrocarbons-bearing zone 24. Natural formation pressure pushes and migrates liquids 96 and gas 98 (FIG. 1) from the surrounding hydrocarbons-bearing zone 24 through the casing perforations 94 and into the interior of the casing 28 at the well bottom 36. The casing perforations 94 are typically located slightly above the well bottom 36, to form a catch basin or "rat hole" where the liquid accumulates at the well bottom 36 inside the casing 28. The liquid 96 has the capability of rising to a level above the casing perforations 94 at which the natural formation pressure is counterbalanced by the hydrostatic head pressure of accumulated liquid and gas above those casing perforations. Natural gas 98 from the hydrocarbons-bearing zone 44 bubbles through the accumulated liquid 96 until the hydrostatic head pressure counterbalances the natural formation pressure, at which point the hydrostatic head pressure chokes off the further migration of natural gas through the casing perforations 94 and into the well.

The upper end of the casing 28 at the well head 32 is closed by a conventional casing seal and tubing hanger 99, thereby closing or capping off the upper end of the casing chamber 60. The casing seal and tubing hanger 99 also connects to the upper end of the production tubing 30 and suspends the production tubing within the casing chamber 60.

Figure 8:
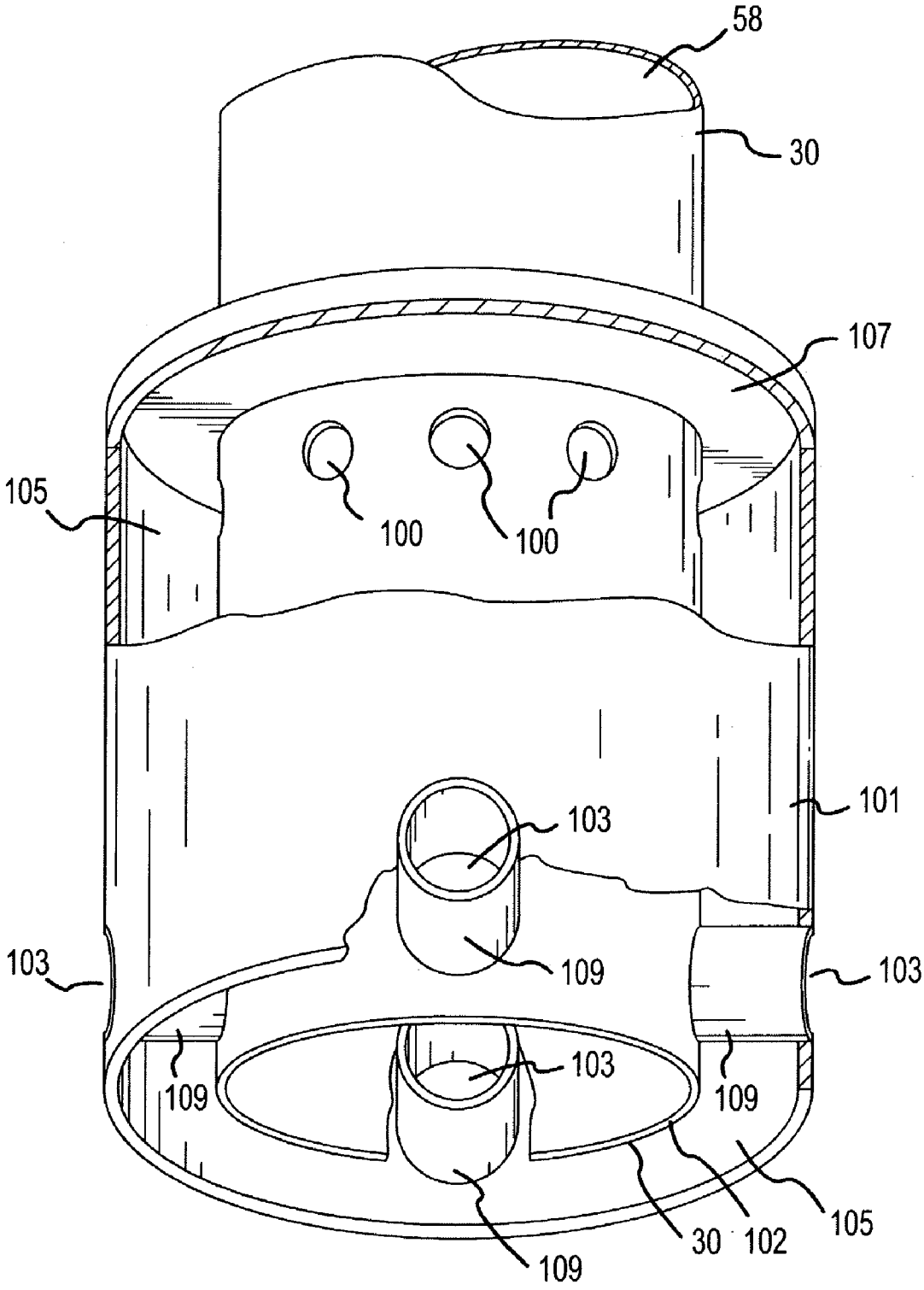
FIG. 8 is an enlarged partial perspective view of a liquid siphon skirt located at a lower end of a production tubing used in the well as shown in FIG. 1.

The liquid 96 which accumulates at the well bottom 36 enters the production tubing 30 through tubing perforations 100 formed above the lower terminal end of the production tubing 30. The liquid 96 flows through the perforations 100 from the interior of a liquid siphon skirt 101 which surrounds the lower end of the production tubing 30. As is also shown in greater detail in FIG. 8, the liquid siphon skirt 101 is essentially a concentric sleeve-like device with a hollow concentric interior chamber 105. The perforations 100 communicate between the production chamber 58 and the interior chamber 105. The interior chamber 105 is closed at a top end 107 (FIG. 8) of the liquid siphon skirt 101 so that the only fluid communication path at the upper end of the skirt 101 is through the perforations 100 between the production chamber 58 and the interior chamber 105.

The lower end of the interior chamber 105 is open, to permit the liquid 96 at the well bottom 36 to enter the interior chamber 105 of the liquid siphon skirt 101. The interior chamber 105 communicates between the open bottom end of the liquid siphon skirt 101 and the perforations 100. Passageways 103 are formed through the interior chamber 105 near the lower end of the liquid siphon skirt 101. The passageways 103 are each defined by a conduit 109 (FIG. 8) which extends through the interior chamber 105 between the outside of the skirt 101 and the interior of the production tubing 30 at a position above a lower end 102 of the production tubing 30. The conduits 109 which define the passageways 103 separates those passageways 103 from the interior chamber 105, so the fluid flow and pressure conditions within the interior chamber 105 are isolated from and separate from the flow and pressure conditions within the passageways 103.

The interior chamber 105 communicates the liquid 96 from the well bottom 36 from the lower open end of the liquid siphon skirt 101 through the perforations 100 into the production chamber 58 of the production tubing 30, during each fluid lift cycle. Similarly, fluid within the production chamber 58 which is forced out of the lower end of the production tubing 30 flows through the perforations 100 and the interior chamber 105 out of the lower open end of the liquid siphon skirt 101 into the well bottom 36. Similarly, gas 98 and liquid 96 at the well bottom 36 flows through the passageways 103 between the exterior of the liquid siphon skirt 101 into the interior of the production tubing 30 at a position adjacent to the open lower end 102 of the production tubing 30. The cross-sectional size of the passageways 103 is considerably larger than the cross-sectional size of the perforations 100. The larger cross-sectional size of the passageways 103 permits pressure from the gas 98 to interact with the traction seal device 40 when it is located at the open lower end 102 of the production tubing 30 and immediately initiate the upward movement of the traction seal device during each liquid lift cycle, as is described below.

A bottom shoulder 104 (FIG. 1) of the production tubing 30 extends inward from the interior sidewall 62 at the lower end 102 of the production tubing 30. The bottom shoulder 104 prevents the traction seal device 40 from moving out of the open lower end 102 when the traction seal device 40 moves downward in the production tubing to the lower end 102. The tubing perforations 100 are located above the location where the traction seal device 40 rests against the bottom shoulder 104.

An upper end of the production tubing 30 is closed in a conventional manner illustrated by a closure plate 106, as shown in FIG. 1. A top shoulder 108 is extends from the inner sidewall 62 near the upper end of the production tubing 34. The top shoulder 108 prevents the traction seal device 40 from moving upward above the location of the top shoulder 108.

The upper end of production chamber 58 is connected in fluid communication with the check valves 52 and 54. The check valves 52 and 54 are also connected in fluid communication with the control valve 46. The control valve 46 is connected in fluid communication with a conventional liquid-gas separator 110. The liquid 96 and gas 98 which are lifted by the traction seal device 40 are conducted through the check valves 52 and 54 and through the control valve 46 into the liquid-gas separator 110. The liquid 96 enters the separator 110, where valuable oil **96*a* rises above any water 96*b*, because the oil 96*a* has lesser density than the water 96*b*. The valuable natural gas 98 is conducted out of the top of the separator 110 through a conventional electronic gas meter (EGM) 111 to a sales conduit 112. The sales conduit 112 is connected to a pipeline or storage tank (neither shown) to allow the valuable hydrocarbons to collect and periodically be sold and delivered for commercial use. The electronic gas meter 111 supplies a signal 113 which represents the volumetric quantity of gas flowing from the separator 110 into the sales conduit 112. Periodically whenever the accumulation of the valuable oil 96*a* in the separator 110 requires it, the oil 96*a* is drawn out of the separator 110 and is also delivered to the sales conduit 112 through another volumetric quantity measuring device (not shown). The water 96*b* is drained from the separator 110 whenever it accumulates to a level which might inhibit the operation of the separator 110**.

The upper end of the casing chamber 60 at the upper closed end of the casing 28 is connected in fluid communication with the control valve 48 and with the check valve 56. The valuable natural gas 98 produced from the casing chamber 60 is conducted through the control valve 48 and into the separator 110, from which the gas 98 flows through to the electronic gas meter 111 to the sales conduit 112.

The check valve 56 connects a conventional accumulator 114 to the casing chamber 60. The accumulator 114 is a vessel in which gas at the natural formation pressure is accumulated from the casing chamber 60 during the liquid lift cycle. The pressurized natural gas in the accumulator 114 is used to force the traction seal device 40 down the production tubing 30 at the end of each liquid lift cycle. To do so, gas flows from the accumulator 114 through a conventional electronic gas meter 117 and into the production chamber 58. The electronic gas meter 117 supplies a signal 119 which represents the volumetric quantity of gas flowing from the accumulator 114 into the production chamber 58.

A controller 115 adjusts the open and closed states of the control valves 46, 48 and 50 to control the flow through them. The controller 115 delivers control signals 116, 118 and 120 to the control valves 46, 48 and 50, respectively, and the control valves 46, 48 and 50 respond to the control signals 116, 118 and 120, respectively, to establish selectively adjustable open and closed states. Pressure transducers or sensors (P) 122 and 124 are connected to the production chamber 58 and the casing chamber 60, respectively. The pressure sensors 122 and 124 supply pressure signals 126 and 128 which are related to the pressure within production chamber 58 and the casing chamber 60 at the wellhead, respectively. The pressure signals 126 and 128 are supplied to the controller 115. The flow signals 113 and 119 from the electronic gas meters 111 and 117, respectively, are also supplied to the controller 115. The controller 115 includes conventional microcontroller or microprocessor-based electronics which execute programs to accomplish each liquid lift cycle in response to and based on the pressure signals 126 and 128 and the flow signals 111 and 117, among other things, as described below.

Figure 9:
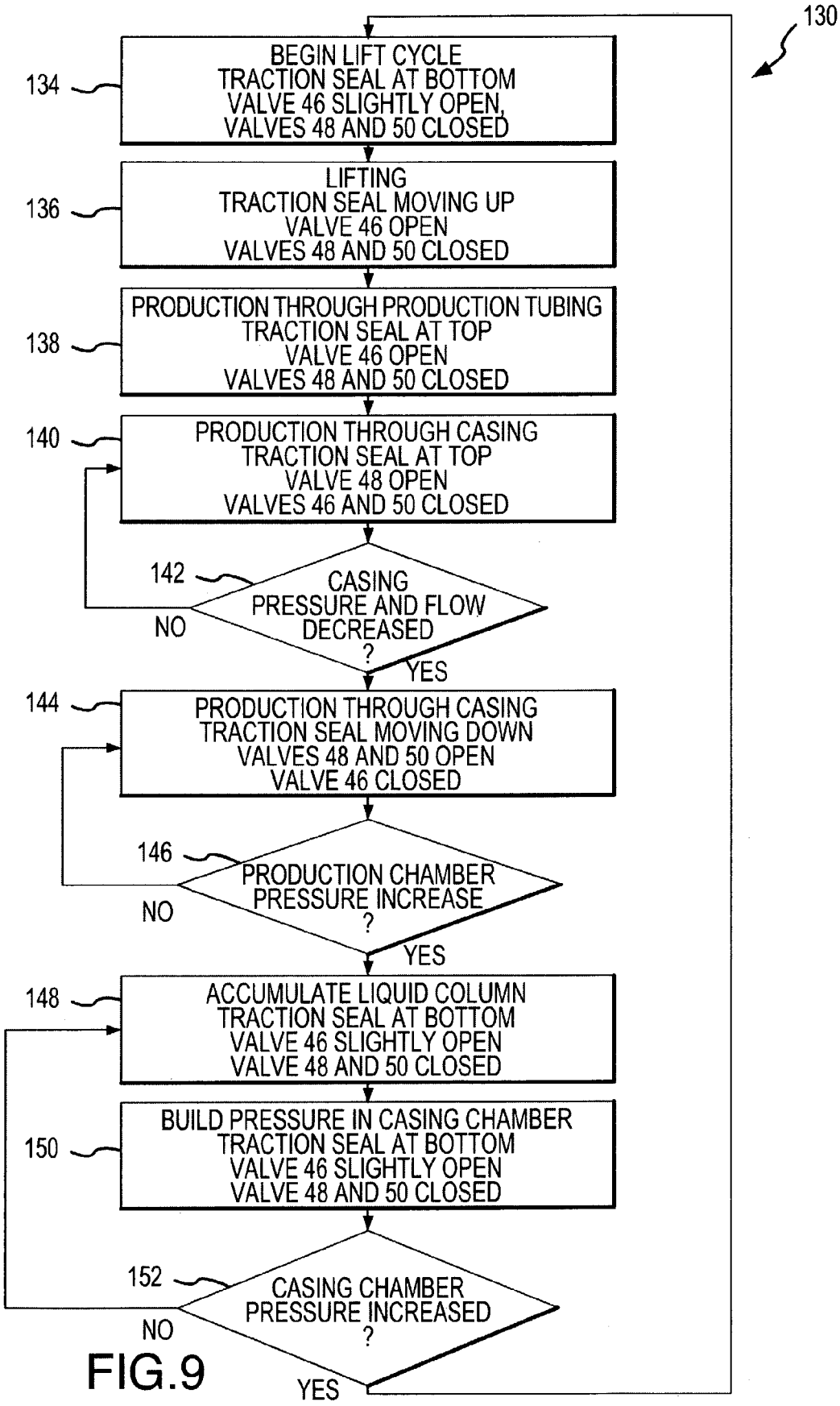
FIG. 9 is a flowchart of functions performed and conditions occurring during different phases of a liquid lifting cycle performed in the well shown in FIG. 1.

Based on the programmed functionality of the controller 115 and the pressure signals 126 and 128 and flow signals 111 and 117, the controller 115 supplies control signals 116, 118 and 120 to the control valves 46, 48 and 50, respectively, to cause those valves, working in conjunction with the check valves 52, 54 and 56, to control the gas pressure and volumetric gas flow in the production chamber 58 and in the casing chamber 60 in a manner which moves the traction seal device 40 up and down the production tubing 30 to lift the liquid from the well in liquid lift cycles. The sequence of events involved in accomplishing a liquid lift cycle is shown in FIG. 9 by a flowchart 130, and by FIGS. 10–16 which describe the condition of the various components in the well 20 during the liquid lift cycle.

Figure 10:
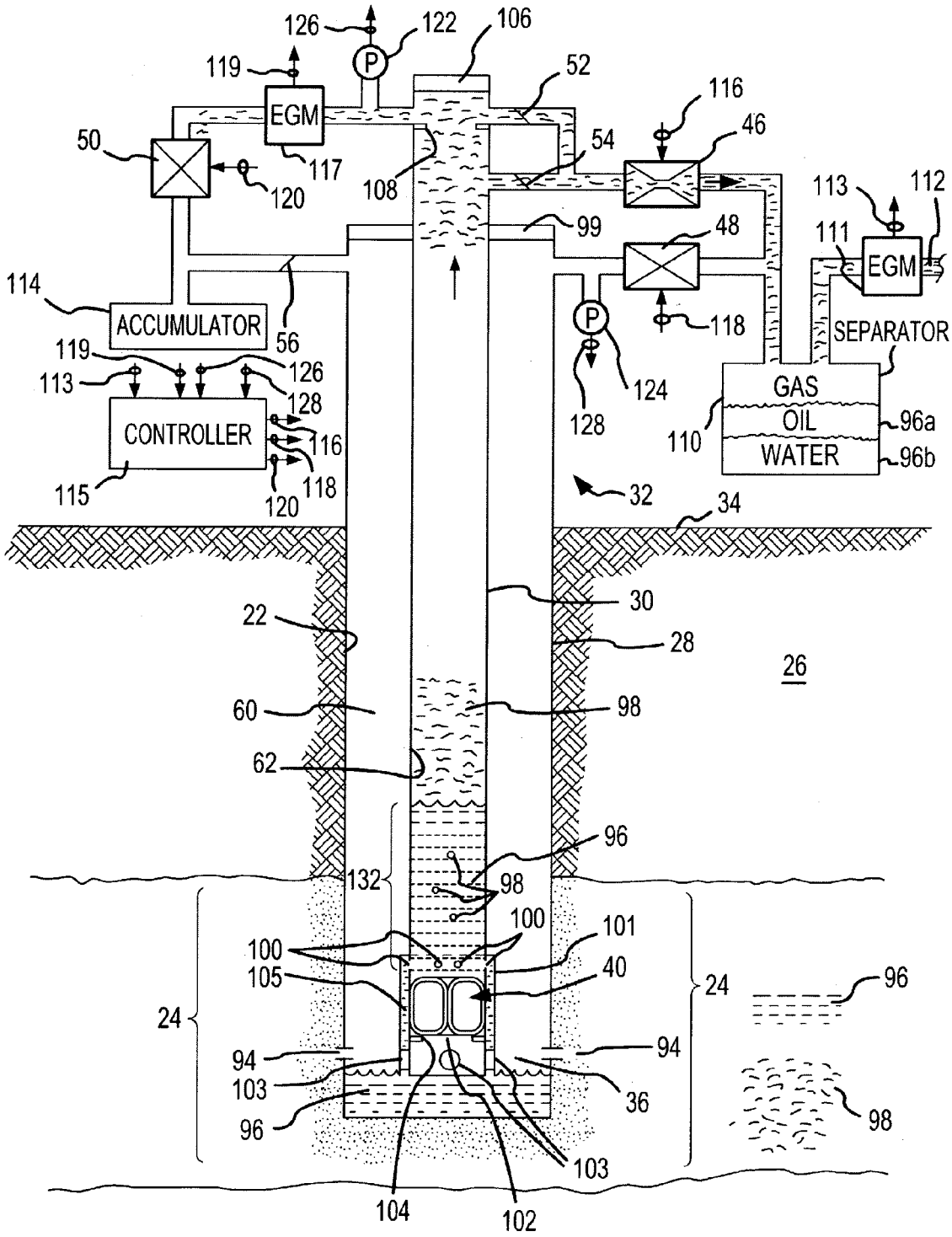
FIGS. 10–16 are simplified views similar to FIG. 1 illustrating of the various phases of a liquid lifting cycle performed in the well shown in FIG. 1 and corresponding with the functions and conditions shown in the flowchart of FIG. 9.

The liquid lift cycle commences as shown in FIG. 10 with the traction seal device 40 seated on the bottom shoulder 104 of the production tubing 30. The control valve 46 is operated to a slightly open position by the control signal 116 from the controller 115. The pressure the production chamber 58 is less than the pressure in the casing chamber 60, because of the slightly open state of the control valve 46. Because of the lower pressure in the production chamber 58, liquid 96 flows from the open bottom end of the liquid siphon skirt 101 through the interior chamber 105 and the perforations 100 into the production tubing 30, where the liquid 96 accumulates above traction seal device 40. The relatively higher and lower pressures in the casing and production chambers 60 and 58, respectively, push the liquid 96 into the production chamber 58 in a column 132 to a height greater than the height of the liquid 96 in the casing chamber 60.

The slightly open condition of the control valve 46 allows gas 98 to flow from the production chamber 58 to the sales conduit 112 while maintaining the pressure differential between the production chamber 58 and the casing chamber 60. The check valves 52 and 54 are open to allow the gas 98 to pass from the production chamber 58 through the control valve 46, but to prevent liquid from the separator 110 and the sales conduit 112 to move in the opposite direction into the production tubing 30. The pressure in the casing chamber 60 and in the accumulator 114 is equalized because the check valve 56 allows the pressure in the accumulator 114 to reach the pressure in the casing chamber 60. The beginning conditions of the liquid lift cycle shown in FIG. 10 are also illustrated at 134 in the flowchart 130 shown in FIG. 9.

The slightly open condition of the control valve 46 also allows the column 132 of liquid 96 to rise in the production tubing 30 to a desired maximum height. At this desired height, the level of the liquid 96 in the casing chamber 60 adjacent to the liquid siphon skirt 101 will be at a level below the passageways 103. Therefore, gas in the casing chamber with 60 is readily communicated through the passageways 103 to the area at the lower open end 102 of the production tubing 30 below the traction seal device 40.

The maximum height to which the liquid column 132 could rise above the traction seal device 40 within the production chamber 58 is that height where its hydrostatic head pressure counterbalances the natural formation pressure in the casing chamber 60. However, it is desirable that the liquid column 132 not rise to that maximum height in order for there to be available additional natural formation pressure to lift the liquid column 132. The pressure signal 128 from the pressure sensor 124 is recognized by the controller 115 as related to the height of the liquid column 132. When the pressure in the casing chamber 60 builds to a predetermined level which is less than the maximum natural formation pressure but which establishes a desired height of the liquid column 132 for lifting while reducing the level of liquid 96 in the well bottom 36 below the level of the passageways 103, the next phase or stage of the liquid lift cycle shown in FIG. 11 commences.

In the phase or stage of the fluid lift cycle shown in FIG. 11 (and at 136 in FIG. 9), the control valve 46 is opened fully to cause a sudden, much greater drop or differential in pressure in the production chamber 58 above the traction seal device 40 compared to the pressure in the casing annulus 60 which is communicated through the passageways 103 below the traction seal device 40. The sudden pressure decrease in the production chamber 58 is communicated more substantially through the larger cross-sectionally sized passageways 103 to the open bottom end 102 of the production tubing 30 than the pressure decrease is communicated through the smaller cross-sectionally sized perforations 100, thereby forcing the traction seal device 40 upward in the production tubing 30 from the bottom position against the shoulder 104 until the traction seal device covers the perforations 100. This movement of the traction seal device 40 starts lifting the liquid column 132 (FIG. 10) and gas 98 above the liquid column 132 in the production chamber 58. Once the traction seal device 40 is above the perforations 100, it continues moving upward by the pressure difference between the greater pressure in the casing chamber 60, communicated through the passageways 103, the open lower end 102 of the production tubing 30, the concentric chamber 105 and the perforations 100, compared to the lesser pressure from the liquid column 132 (FIG. 10) and any gas pressure in the production chamber 58 above the liquid column 132. This lifting condition is illustrated at 136 in FIG. 9.

Figure 11:
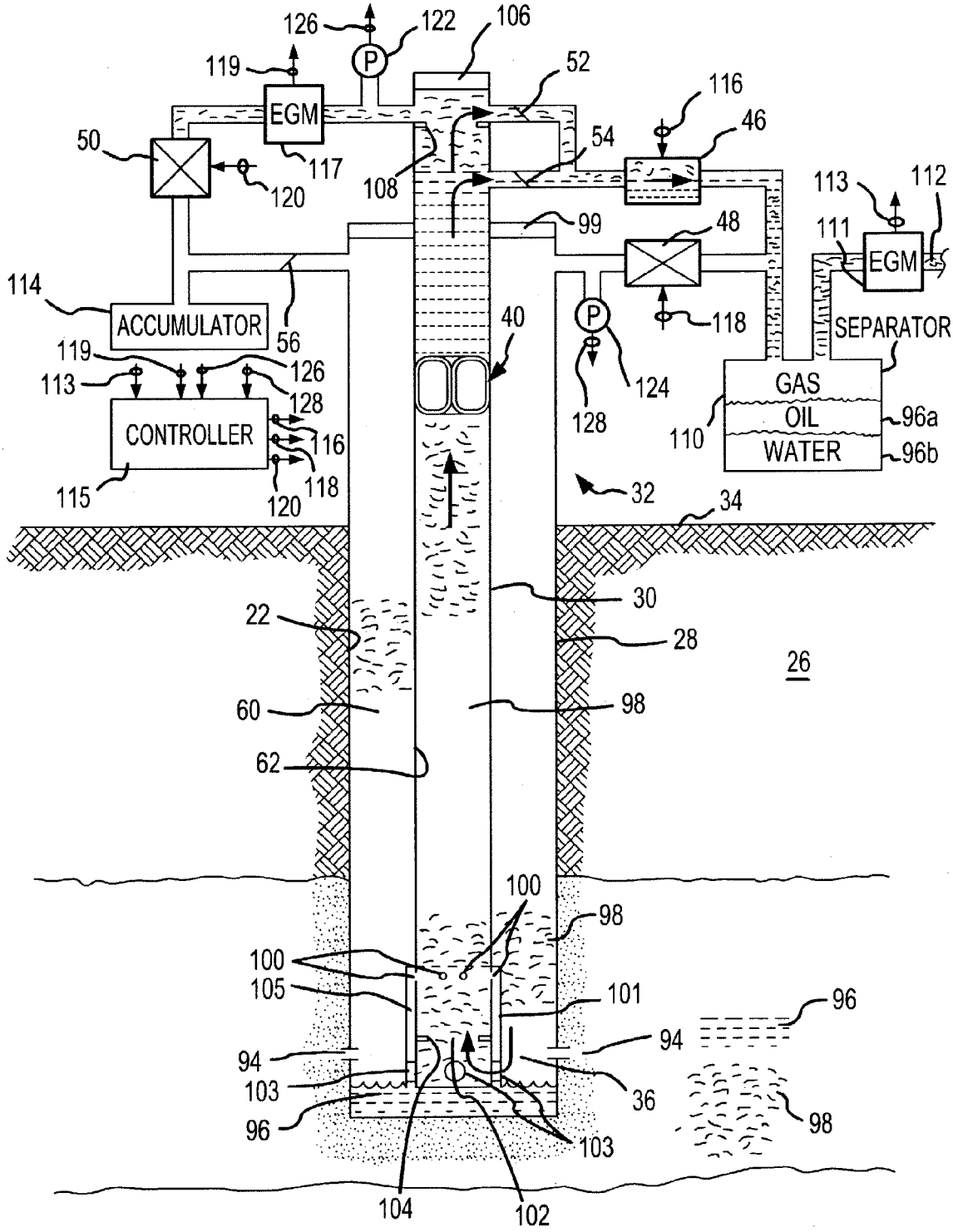

As the traction seal device 40 continues moving up the production tubing 30, as shown in FIG. 11 and at step 138 in FIG. 9, the gas at the natural formation pressure in the casing chamber 60 continues to enter the lower open the end 102 of the production tubing 30 through the passageways 103 to press the traction seal device 40 upward. The traction seal device 40 is rolled upward within the production chamber 58 by essentially frictionless rolling contact with the production tubing 30, and the column of liquid (132, FIG. 10) above the traction seal device 40 is lifted by this pressure differential between the greater natural formation pressure below the traction seal device 40 and the relatively lower pressure from the liquid column (132, FIG. 10) and any gas in the production chamber 58 above the traction seal device 40. Therefore, in order for the traction seal device 40 to move up from the natural formation pressure, the liquid column 132 must not create such a high hydrostatic head pressure as to counterbalance the natural formation pressure.

As the traction seal device 40 moves up the production tubing 30, the natural gas 98 above the liquid column 132 is produced through the check valves 52 and 54 and through the open control valve 46. The natural gas 98 flows into the separator 110 and from the separator into the sales conduit 112. The volumetric flow rate of the gas produced is determined by the controller 115 based on the signal 113. This volumetric flow rate is related to the speed that the traction seal device 40 is moving up the production tubing 30. To the extent that the upward speed of the traction seal device is too great, the controller 115 modulates or adjusts the open state of the control valve 46 by the signal 116 applied to the valve 46. In this manner, premature wear or destruction of the traction seal device 40 from high speed operation is avoided.

As the traction seal device 40 nears the upper end of the production tubing 30, the liquid 96 in the column 132 is also delivered through the check valves 52 and 54 and the open control valve 46 and into the separator 110. Any valuable oil 96*a* is separated from any water 96*b* in the separator 110. The valuable oil 96*a* is periodically removed from the separator 110 and sold.

Figure 12:
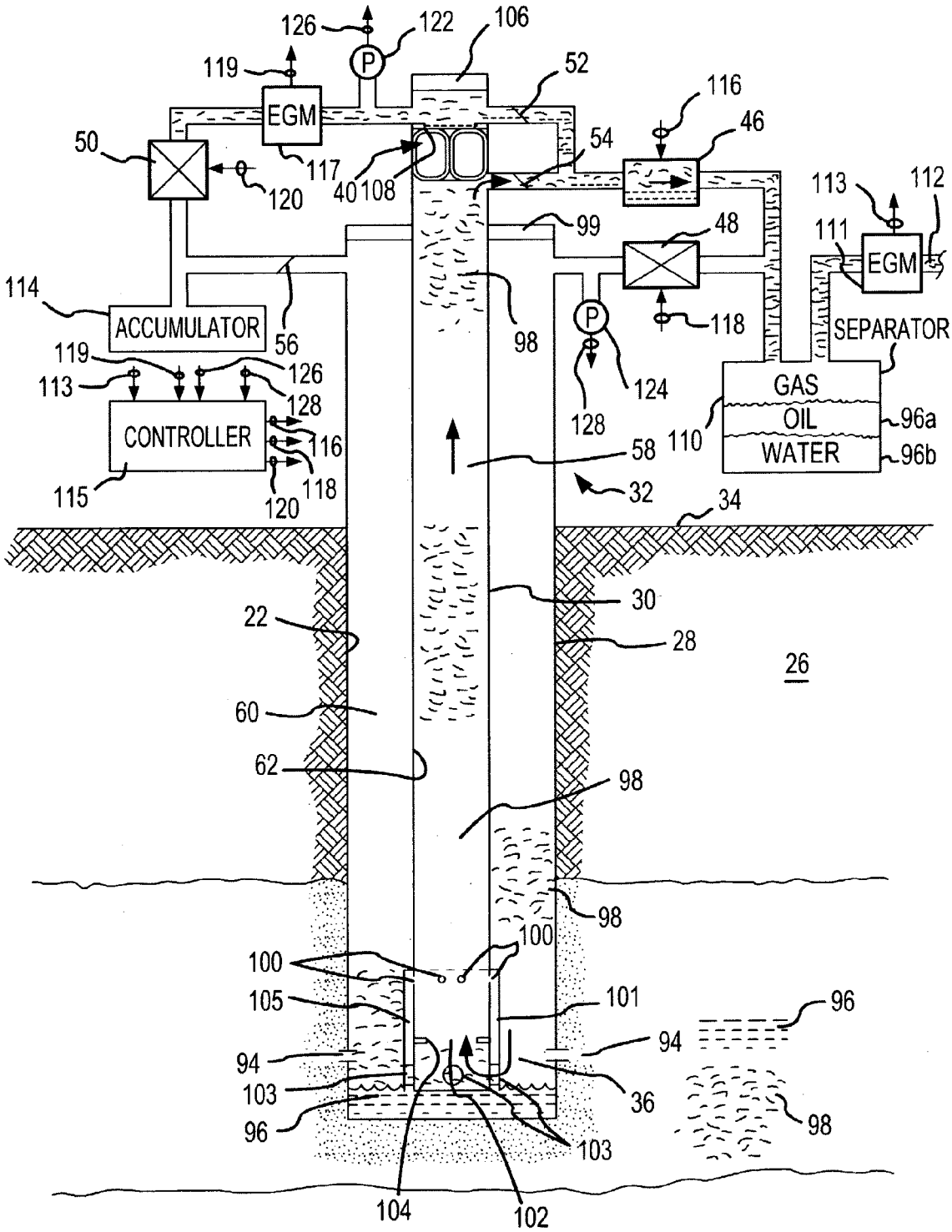

Once the traction seal device 40 has reached the top shoulder 108, essentially all of the liquid 96 and gas 98 above the traction seal device 40 has been transferred through the check valves 52 and 54 and the open control valve 46 into the separator 110. With the traction seal device located against the top shoulder 108, a flow path exits from the production chamber 58 through the open valve 46 at a location below the traction seal device 40, to allow any gas within the production chamber 58 behind the traction seal device to flow into the separator 110 and into sales conduit 112, as shown in FIG. 12 and at 138 in FIG. 9.

Figure 13:
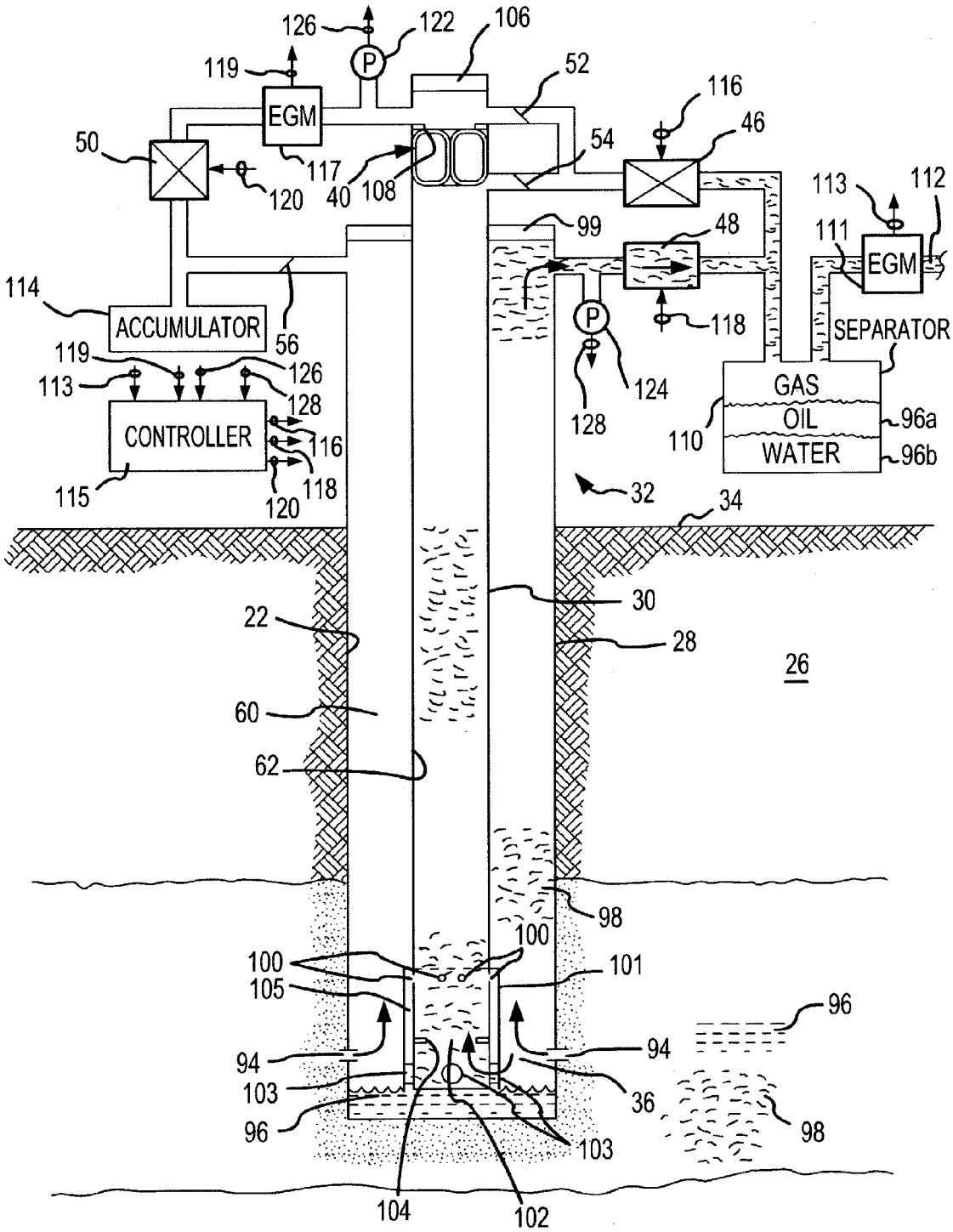

When the traction seal device 40 moves into contact with the top shoulder 108 at the wellhead 32, the location of the traction seal device 40 against the top shoulder 108 is determined by a pressure signal 126 from the pressure sensor 122. The controller 115 responds to this pressure signal and closes the control valve 46 and opens control valve 48, as shown in FIG. 13 and at 140 in FIG. 9. Gas flows from the casing chamber 60 through the open control valve 48 into the separator 110 and from there into the sales conduit 112. Removing gas 98 from the casing chamber 60 through the open control valve 48 at this phase or stage of the liquid lift cycle recovers that natural gas 98 which has accumulated in the casing chamber 60 while the traction seal device 40 moved up the production tubing 30.

Figure 14:
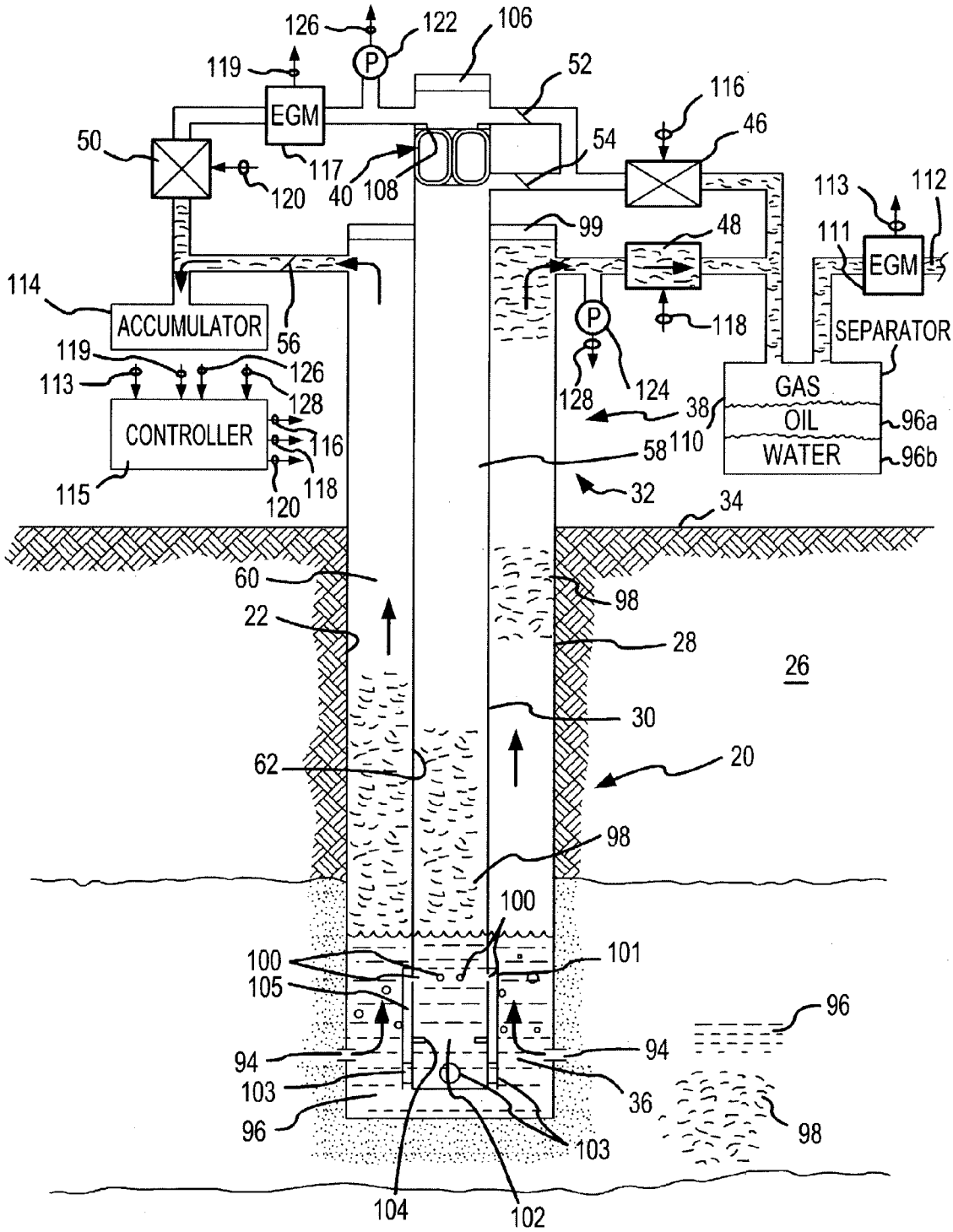

The reduced pressure in the casing chamber 60, created by removing the gas through the open control valve 48, allows the formation pressure to push more liquid 96 and gas 98 through the casing perforations 94 and into the casing chamber 60 at the well bottom 38, as shown in FIG. 14. The control valve 48 stays open to permit gas to continue to flow from the casing chamber 60 and into the separator 110 and from there into the sales conduit 112, until the liquid 96 rises to a level in the well bottom 36 where gas pressure in the casing chamber 60 diminishes to a predetermined value. The gas pressure in the casing chamber 60 diminishes as a result of the counterbalancing effect of the hydrostatic head of liquid 96 at the well bottom 36. The pressure in the casing chamber 60 is reflected by the pressure signal 128. The volumetric gas flow from the casing chamber 60 is also diminished. The diminished volumetric gas flow from the casing chamber 60 through the open control valve 48 is reflected by the signal 113 from the electronic gas meter 111. The controller 115 responds to the pressure signal 128 from the pressure sensor 124 and the signal 113 from the electronic gas meter 111, to make a determination at 142 (FIG. 9) when the gas pressure condition in the casing chamber 60 reaches a predetermined value where the volumetric production from the casing chamber 60 has diminished. So long as the gas pressure and the volumetric production from the casing chamber 60 remain adequate, as reflected by a negative determination at 142 (FIG. 9), the controller 115 maintains the valve 48 in the open condition shown in FIG. 14 so that gas production from the casing chamber 60 is continued.

Upon reaching the predetermined gas pressure and flow conditions indicative of diminished gas production from the casing chamber 60, shown by a positive determination at 142 (FIG. 9), a sufficient amount of liquid 96 has accumulated in the well bottom 36, as shown in FIG. 14, to require its removal in order to sustain production from the well. At this point, it is necessary to remove the accumulated liquid at the well bottom 36.

Figure 15:
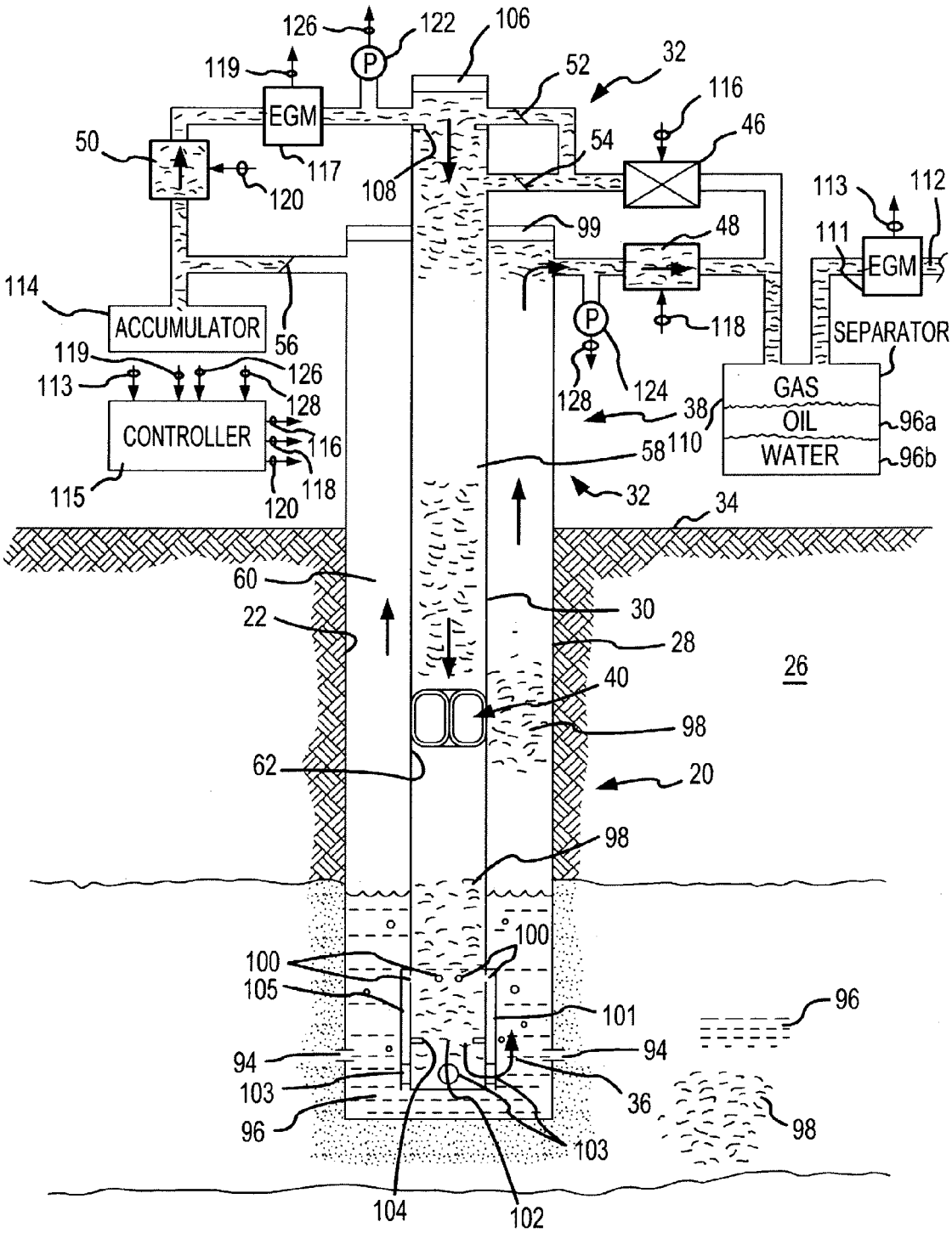

In response to the diminishing pressure and volumetric flow in the casing chamber 60, indicated by the signals 128 and 113, the controller 115 delivers a control signal 120 to operate the control valve 50 to an open position, as shown in FIG. 15 and at 144 in FIG. 9. Opening the control valve 50 allows the pressurized gas stored in the accumulator 114 to flow into the production tubing 30 at a location above the traction seal device 40. The gas pressure from the accumulator 114 forces the traction seal device 40 down the production tubing 30. The gas pressure above the traction seal device 40 is greater than the gas pressure within the production chamber 58 below the traction seal device 40, because the control valve 48 remains open and because the time during which the control valve 48 was previously opened has been sufficient to substantially reduce the pressure within the casing chamber 60.

The gas in the production chamber 58 below the downward moving traction seal device 40 forces downward the level of liquid 96 within the lower end 102 of the production tubing 30 and within the interior chamber 105 of the liquid siphon skirt 101, until the gas within the production chamber 58 below the traction seal device 40 starts bubbling out of the open lower end of the interior chamber 105 of the liquid siphon skirt 101. The gas bubbles through the liquid 96 and into the casing chamber 60. In this manner, the gas below the traction seal device 40 does not inhibit its downward movement, and the gas below the traction seal device 40 is transferred into the casing chamber 60 as the traction seal device 40 moves down the production tubing 30. The downward moving traction seal device 40 also forces more gas from the casing chamber 60 through the open control valve 48 into the sales conduit 112.

In order to prevent over-speeding and possible premature damage to or destruction of the traction seal device 40 during its downward descent through the production tubing 30, or in order to prevent under-speeding and possible stalling of the traction seal device 40 near the end of its downward movement near the bottom of the production tubing 30, the volumetric flow through the valve 50 is controlled. The volumetric flow through the valve 50 is controlled by modulating or adjusting the open state of the valve 50 with the valve control signal 120 supplied by the controller 115. The extent of adjustment of the open state of the valve 50 is determined by the volumetric flow signal 119 from the electronic gas meter 117 and by the pressure signal 126 from the pressure sensor 122. Modulating or adjusting the open state of the valve 50 with the control signal 120 is also useful in controlling the delivery of gas from the accumulator 114 since it is a confined pressure source whose pressure decays with increasing gas flow out of the accumulator 114.

Figure 16:
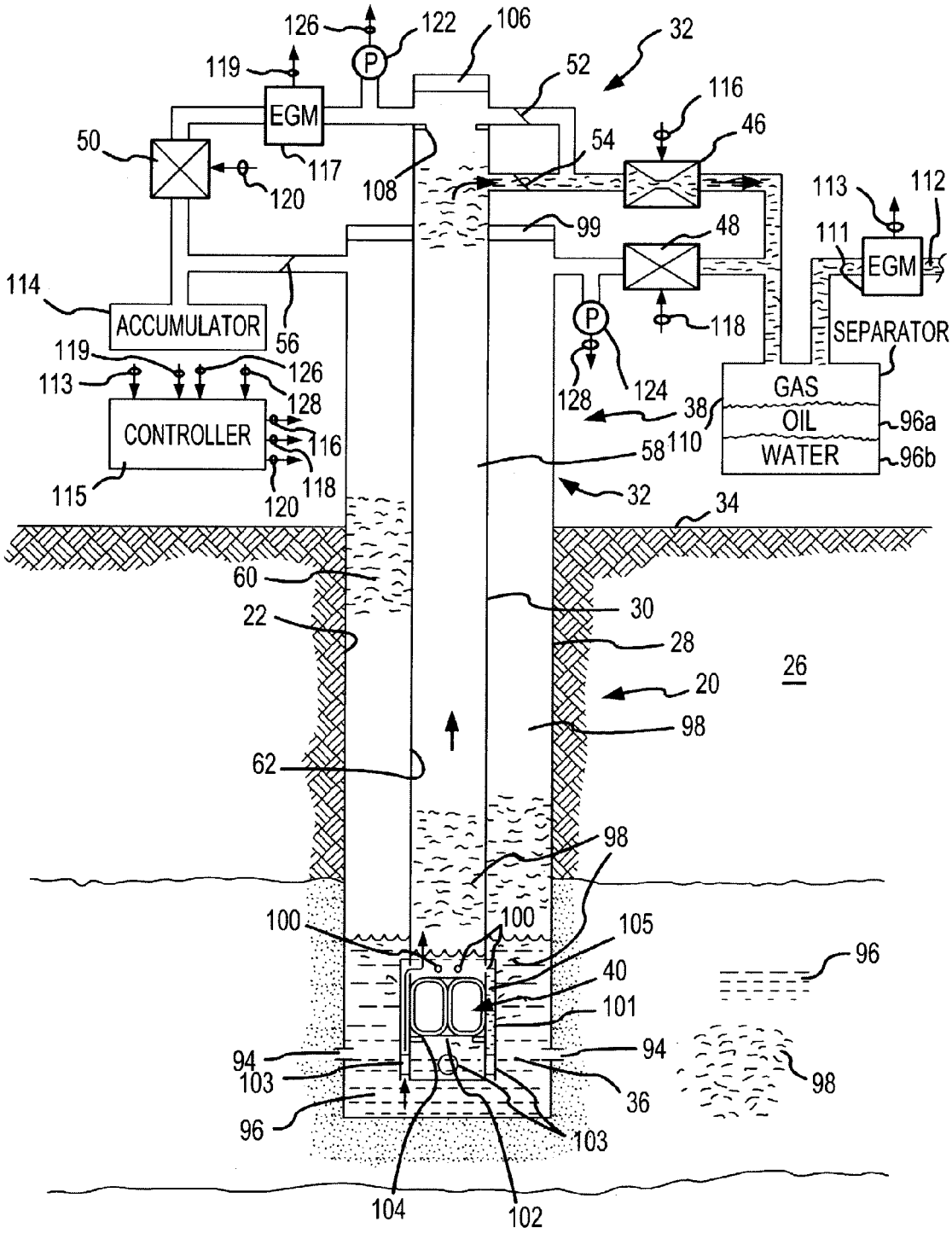

The gas pressure from the accumulator 114 flowing through the open valve 50 continues to force the traction seal device 40 downward through the production tubing 30 until the traction seal device 40 rests against the bottom shoulder 104, as shown in FIG. 16. When the traction seal device 40 seats at the bottom shoulder 104 of the production tubing 30, the gas pressure in the production chamber 58 increases slightly, because the traction seal device 40 closes the open bottom end 102 of the production tubing 30 and forces gas through the tubing perforations 100. The tubing perforations 100 are smaller in size than the passageways 103 and the open bottom end 102 of the production tubing 30, thereby causing the gas pressure within the production chamber 58 above the traction seal device 40 to increase in pressure. This slight increase in pressure is sensed by the pressure sensor 122 and the resulting pressure signal 126 is applied to the controller 115. The volumetric flow through the open valve 50 also diminishes, as sensed by the electronic gas meter 117, because the traction seal device 40 seals the bottom open end of the production tubing 30.

The controller 115 determines from the signals 126 and 119, at 146 (FIG. 9), whether the sensed pressure and volumetric flow conditions indicate the arrival of the traction seal device 40 at the end 102 of the production tubing 30. A negative determination at 146 (FIG. 9) causes the controller 115 to continue to deliver gas from the accumulator 114, because the traction seal device 40 has not yet reached the bottom of the production tubing 30. However, upon an affirmative determination at 146 (FIG. 9), the controller 115 responds by delivering control signals 118 and 120 to close the control valves 48 and 50 and to open slightly the control valve 46, as shown in FIG. 16.

The slightly open adjusted condition of the control valve 46 allows the liquid 96 to begin accumulating in the liquid column 132 within the production tubing 30 from the well bottom 36, as previously described and shown in FIG. 16 and at 148 in FIG. 9. The liquid 96 continues to accumulate in the well bottom 36, and the natural gas 98 continues to accumulate in the casing chamber 60, as shown in FIG. 16 and at 150 in FIG. 9. The pressure of the gas in the casing chamber 60 is evaluated at 152 (FIG. 9) by the controller 115 based on the pressure signal 126. A negative determination at 152 (FIG. 9) continues until sufficient pressure is reached to commence another lift cycle, and that condition is represented by a positive determination at 152 (FIG. 9). Once the gas pressure has risen sufficiently, as shown by a positive determination at 152, the program flow 130 reverts from 152 back to 134, as shown in FIG. 9. Another liquid lift cycle begins at 134 with the conditions previously described in conjunction with FIG. 10.

While the control valve 48 is closed, the casing chamber 60 is shut in, which causes the gas pressure within the casing chamber 60 to build from natural formation pressure. As the gas pressure in the casing chamber 60 increases, the check valve 56 opens to charge the accumulator 114 with gas pressure equal to that in the casing chamber 60. The accumulator recharges with pressure as the pressure builds within the shut-in casing chamber 60. In this manner, sufficient gas pressure is accumulated within the accumulator 114 to drive the traction seal device down the production tubing at the end of the next liquid lift cycle.

Figure 17:
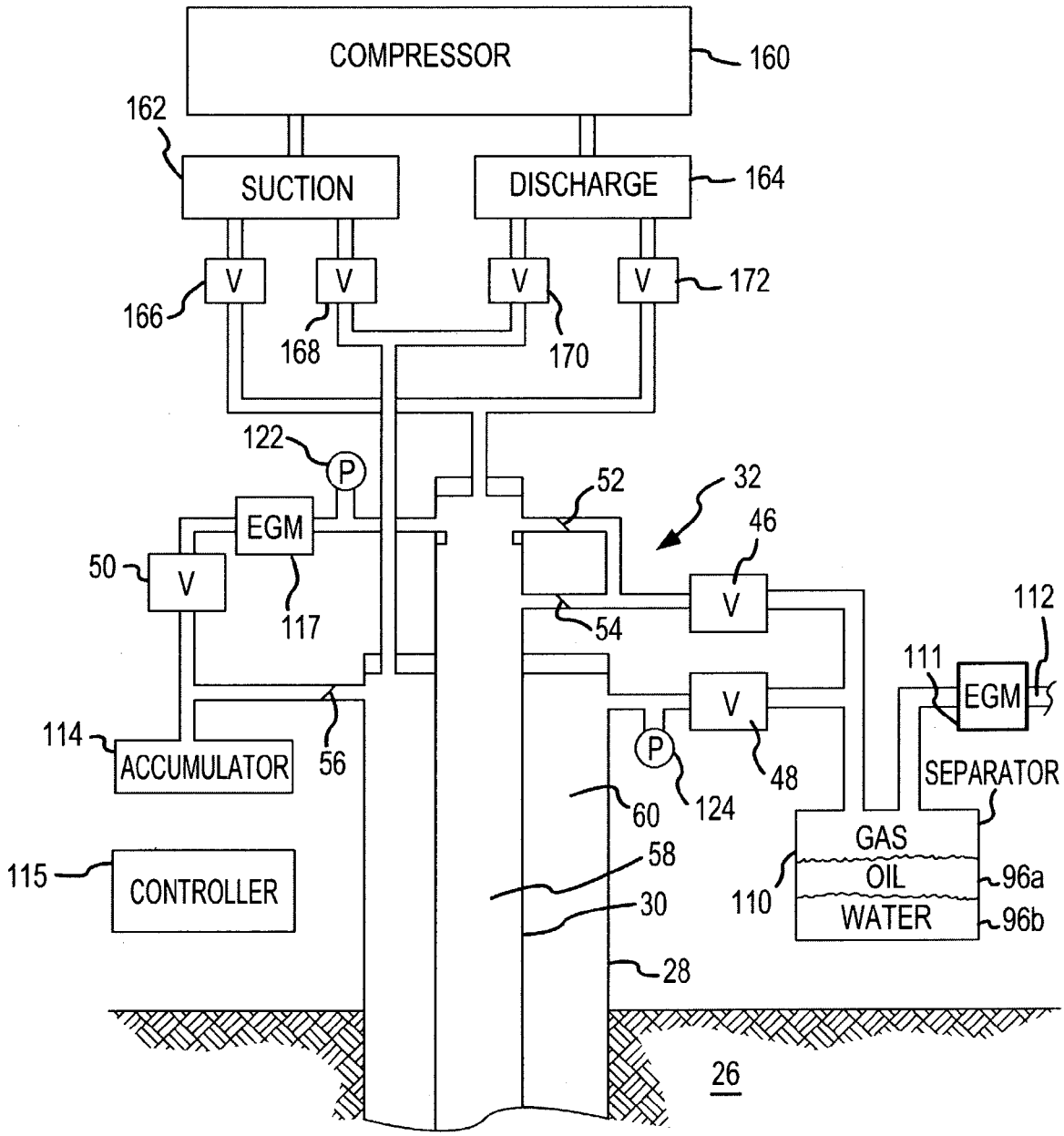
FIG. 17 is a partial view of a portion of the FIG. 1 illustrating an alternative embodiment of the present invention using a compressor.

Although one of the substantial benefits of the present invention is that the essentially complete seal created by the traction seal device permits natural gas at natural formation pressure to be used as the energy source for lifting the liquid from the well 20, thereby substantially diminishing the costs of pumping the liquid to the surface, there may be some circumstances where the well 20 has insufficient or nonexistent natural formation pressure to move the traction seal device 40 up and down the production tubing 30. In those circumstances, a relatively small-capacity or low-volume, low-pressure compressor 160 may be used, as shown in FIG. 17, to either augment or replace natural formation pressure. The compressor 160 is connected to create the necessary pressure differentials between the production chamber 58 and the casing chamber 60 to cause movement of the traction seal device 40 in the liquid lift cycle previously described. To the extent that the compressor 160 is used to augment the effects of natural formation pressure, the points in the liquid lift cycle where the compressor 160 becomes effective for purposes of augmentation are determined by the controller 115 in response to the pressure and volumetric flow signals 126, 128, 113 and 119 (FIG. 1).

The compressor 160 is preferably connected to the production chamber 58 and the casing chamber 60 as shown in FIG. 17. The compressor includes a low-pressure suction manifold 162 and a high-pressure discharge manifold 164. Operating the compressor 160 creates low-pressure gas in the suction manifold 162 and high-pressure gas in the discharge manifold 164. Control valves 166 and 168 are connected between the suction manifold 162 and the production chamber 58 and the casing chamber 60, respectively. Control valves 170 and 172 are connected between the discharge manifold 164 and the casing chamber 60 and the production chamber 58, respectively. Arranged in this manner, the controller 115 delivers control signals (not shown) to open and close the valves 166, 168, 170 and 172 on a selective basis to apply the low-pressure gas from the suction manifold 162 and the high-pressure gas from the discharge manifold 164 to either of the chambers 58 or 60. For example, applying high-pressure gas to the casing chamber 60 while the control valve 46 is open causes the traction seal device 40 to move up the production tubing 30 and transfer the column of liquid through the open control valve 46 to the separator 110 and the sales conduit 112 (FIG. 1). As another example, applying high-pressure gas to the production chamber 58 while the control valve 48 is open causes the traction seal device 40 to move down the production tubing 30 (FIG. 1). When used in this manner, it is desirable that the compressor 160 pump natural gas and not atmospheric air, thereby permitting only natural gas to exist within the well 20.

The present invention may also be used in wells in which three chambers are established. The three chambers include the production chamber 58, the casing chamber 60, and an intermediate chamber (not shown) which surrounds the production tubing 30 but which is separate from the casing chamber 60, as may be understood from FIG. 1. In general, creating the third chamber will require the insertion of another tubing (not shown) between the production tubing 30 and the casing 28 (FIG. 1). The intermediate chamber offers the opportunity of creating differential pressure relationships on the traction seal device 40 and in the production chamber 58, in isolation from the natural formation pressure existing within the casing chamber 60. An example of a lifting apparatus in which three chambers are employed to create different relative pressure relationships for pumping a well is described in U.S. Pat. No. 5,911,278.

There are many advantages to the use of the traction seal device 40. The resilient flexibility and compressibility of the traction seal device 40 establishes an effective seal across the production tubing. This seal effectively confines the column of liquid (132, FIG. 10) above the traction seal device as it travels up the production tubing 30. As a consequence, very little of the liquid above the traction seal device is lost during the upward movement, in contrast to mechanical plungers and other devices which have greater liquid loss due to the necessity for mechanical clearances between the moving parts. Although the movement of the traction seal device 40 up the production tubing 30 may be slower than the typical vertical speed of a mechanical plunger, the liquid lift efficiency will typically be more effective because less liquid will be lost during the upward movement.

The seal against the sidewall 62 of the production tubing 30 essentially completely confines the gas pressure below the traction seal device 40, allowing the gas pressure to create a better lifting effect. This is an advantage over mechanical systems which permit some of the gas pressure to escape because of the clearance required between moving parts. The ability to confine substantially all of the gas pressure beneath the traction seal device allows lower gas pressure to lift the column of liquid and contributes significantly to permitting natural formation pressure to serve as adequate energy for lifting the column of liquid. Consequently, the present invention will usually remain economically effective in wells having diminished natural formation pressure when other types of mechanical lifts or pumps are no longer able to operate or to operate economically. Although the compressor 160 may be required in certain wells, the amount of auxiliary equipment to operate the present invention is typically reduced compared to the auxiliary equipment required for mechanical plunger lifts.

Since the traction seal device 40 makes rolling, substantially-frictionless contact with the interior sidewall 62 of the production tubing 30, there is no significant relative movement between these parts which would wear the interior sidewall 62 of the production tubing 30. Other than elastomeric flexing, the exterior skin 70 of the traction seal device 40 does not experience relative movement or wear as a result of contact with the interior sidewall 62 of the production tubing.

The resiliency of the traction seal device 40 allows it to conform to and pass over and through irregular shapes, pits and corrosion in the production tubing. Older jointed production tubing used in oil and gas wells is not always perfectly round in cross section, does not always have the same inside diameter, and often has grooves worn in it by the action of rods, as well as a variety of other irregularities. In the case of coiled tubing, bends or other slight irregularities are created when the tubing is uncoiled and inserted into the well. Because of the deformable elastomeric characteristics of the traction seal device, it is able to maintain the effective seal by matching or conforming with the inside shape of the production tubing when encountering such irregularities. Similarly, deposits of paraffin or other natural materials within the production tubing, or even small pits in the sidewall or transitions between sections of production tubing can be accommodated, because the outside surface 70 (FIGS. 3–7) bridges over and seals those irregularities as the traction seal device moves along the production tubing 30. The traction seal device 40 is able to transition between different sections of production tubing having slightly different inside diameter sizes with no loss of sealing effectiveness. Its flexible resilient characteristics permit the traction seal device to expand and contract in a radial direction in the production tubing and still maintain an effective seal.

Some types of the production tubing have an inside flashing or raised or a raised ridge where sheet metal was rolled and welded together to form the tubing. The traction seal device 40 is able to move over the flashing and still maintain an effective seal for lifting the liquid from the well. The traction seal device 40 is also able to work in significantly deviated and non-vertical wells where mechanical pumps, such as rod pumps, would be unable to do so because of the extent of deviation or curvature of the well.

In general, the limited friction and more effective sealing capability has the capability for significant economy of operation, compared to conventional plunger lift pumps and other types of previous conventional fluid lift pumps. As a result, effective amounts of fluid can be lifted from the well for the same amount of energy expended compared to other types of pumps, or alternatively, for the same expenditure of energy, there is an ability to lift the same amount of liquid from a well of greater depth. These and many other advantages and improvements will become more apparent upon gaining a full appreciation for the present invention.

Presently preferred embodiments of the present invention and many of its improvements have been described with a degree of particularity. This description is of preferred examples of the invention, and is not necessarily intended to limit the scope of the invention. The scope of the invention is defined by the following claims.

The invention claimed is:

1. Apparatus for pumping liquid from a well through a production tubing that has an inner sidewall which defines an interior production chamber, comprising:

a fluid displacement device moveably positioned within the production tubing and which rolls in contact with the inner sidewall during upward and downward reciprocating movement within the production tubing while simultaneously maintaining a seal across the inner sidewall during the reciprocating movement; and a valve assembly connected in fluid communication with the production chamber for establishing relative pressure differentials across the fluid displacement device in the production tubing to move the fluid displacement device upward within the production tubing to lift liquid within the production chamber and to move the fluid displacement device downward within the production tubing after lifting the liquid.

2. Apparatus as defined in claim 1, wherein:

the rolling contact of the fluid displacement device with the inner sidewall is essentially frictionless.

3. Apparatus as defined in claim 1, wherein:

the fluid displacement device is compressed against the inner sidewall.

4. Apparatus as defined in claim 3, wherein:

the fluid displacement device is resiliently flexible in a direction perpendicular to the inner sidewall.

5. Apparatus as defined in claim 4, wherein:

the fluid displacement device is resiliently flexible at each point in contact with the inner sidewall independently of other points in contact with the inner sidewall.

6. Apparatus as defined in claim 1, wherein:

the fluid displacement device comprises a toroid shaped structure having an exterior elastomeric skin defining a cavity within which a viscous material is confined.

7. Apparatus as defined in claim 6, wherein:

the toroid shaped structure has an outside surface which contacts the inner sidewall and an inside surface which contacts itself.

8. Apparatus as defined in claim 7, wherein:

the contact of the outside surface with the inner sidewall and the contact of the inside surface with itself establishes the seal to confine the lifted liquid within the production chamber.

9. Apparatus as defined in claim 8, wherein:

the toroid shaped structure rolls during movement of the fluid displacement device within the production tubing;

the outside surface rolls into contact with the inner sidewall; and the inside surface rolls into contact with itself.

10. Apparatus as defined in claim 9, wherein:

the elastomeric exterior skin applies compression force on the viscous material to force the outside surface into contact with the inner sidewall and to force the inside surface into contact with itself.

11. Apparatus as defined in claim 10, wherein:

the elastomeric exterior skin is resiliently flexible in a direction perpendicular to the inner sidewall.

12. Apparatus as defined in claim 10, wherein:

the toroid structure is elongated along the length of the inner sidewall to the extent necessary to establish the compression force on the viscous material.

13. Apparatus as defined in claim 1, wherein the well includes a casing which extends into a well bottom at a subterranean zone which contains liquid and gas, the production tubing extends within the casing to the well bottom, a casing chamber is defined between the casing and the production tubing, and natural formation pressure within the subterranean zone flows the liquid and gas into the casing chamber at the well bottom, and wherein:

the valve assembly is connected in fluid communication with the casing chamber;

the production chamber is connected in fluid communication with the casing chamber at lower ends of the production tubing and the casing at the well bottom; and the valve assembly establishes the pressure differential between the casing chamber and the production chamber to move the fluid displacement device upward within the production tubing from pressure of the gas within the casing chamber at natural formation pressure.

14. Apparatus as defined in claim 13, wherein the production tubing and the casing extend to upper ends at the earth surface, and wherein:

the valve assembly connects the upper end of the production chamber is in fluid communication with a pressure which is less than the pressure within the casing chamber during upward movement of the fluid displacement device within the production tubing.

15. Apparatus as defined in claim 14, wherein:

the valve assembly connects the upper end of the production chamber in fluid communication with a pressure which is greater than the pressure within the casing chamber during downward movement of the fluid displacement device within the production tubing.

16. Apparatus as defined in claim 15, further comprising:

an accumulator which contains gas accumulated from the casing chamber at substantially the natural formation pressure; and wherein:

the valve assembly connects the casing chamber to the accumulator to accumulate gas at the pressure within the casing chamber within the accumulator; and the valve assembly connects the accumulator to the upper end of the production chamber during downward movement of the fluid displacement device.

17. Apparatus as defined in claim 14, wherein:

the valve assembly connects the upper end of the casing chamber in fluid communication to produce gas from the casing chamber at the earth surface upon the fluid displacement device reaching an upper position within the production tubing.

18. Apparatus as defined in claim 13, wherein:

the production chamber is in fluid communication with the casing chamber at the lower ends of the production tubing and the casing at the well bottom;

the casing chamber at the lower end of the casing is in fluid communication with the subterranean zone which contains liquid and gas, and the liquid at the well bottom moves into the production chamber above the fluid displacement device upon the fluid displacement device moving into a lower bottom position within the production tubing.

19. Apparatus as defined in claim 1, wherein the well includes a casing which extends into a well bottom at a subterranean zone which contains liquid and gas, the production tubing extends within the casing to the well bottom, a casing chamber is defined between the casing and the production tubing, and natural formation pressure within the subterranean zone flows the liquid and gas into the casing chamber at the well bottom, and wherein:

the production chamber is in fluid communication with the casing chamber at the lower ends of the production tubing and the casing at the well bottom; and the valve assembly applies the relative pressures to the production and casing chambers to move the fluid displacement device within the production tubing from a difference in gas pressure within the casing chamber relative to the production chamber.

20. Apparatus as defined in claim 19, wherein the production tubing and the casing extend to upper ends at above the earth surface, and wherein:

the valve assembly connects the upper end of the production chamber to flow liquid and gas from the production chamber at a pressure less than the pressure within the casing chamber during upward movement of the fluid displacement device within the production tubing.

21. Apparatus as defined in claim 20, wherein:

the valve assembly flows the liquid and gas from the production chamber into a sales conduit during upward movement of the fluid displacement device within the production tubing.

22. Apparatus as defined in claim 20, wherein:

the valve assembly flows gas to the upper end of the production chamber at a pressure greater than the pressure within the casing chamber during downward movement of the fluid displacement device within the production tubing.

23. Apparatus as defined in claim 22, further comprising:

a sales conduit within which to deliver gas to be sold from the well; and wherein:

the valve assembly connects the upper end of the casing chamber is connected to flow gas from the casing chamber into the sales conduit during downward movement of the fluid displacement device within the production tubing.

24. Apparatus as defined in claim 20, further comprising:

a sales conduit within which to deliver gas to be sold from the well; and wherein:

the valve assembly connects the upper end of the casing chamber to flow gas from the casing chamber into the sales conduit after the fluid displacement device has moved to an upper position within the production tubing.

25. Apparatus as defined in claim 20, wherein:

the production chamber is in fluid communication with the casing chamber at the lower ends of the production tubing and the casing at the well bottom; and the liquid at the well bottom moves into the production chamber above the fluid displacement device upon the fluid displacement device moving to a lower bottom position within the production tubing.

26. An apparatus for pumping liquid from a bottom of a well located in a subterranean formation to an earth surface, comprising:

a production tubing that extends in the well from the well bottom to the earth surface for conducting the liquid from the subterranean formation to the earth surface;

a generally toroid shaped device movably positioned in the production tubing, the toroid shaped device having a deformable skin which surrounds a viscous interior material, the toroid shaped device moving along the length of the production tubing while a portion of the deformable skin maintains static contact with the production tubing and maintains a seal across the production tubing to lift the liquid above the toroid shaped device while the toroid shaped device moves upward within the production tubing; and a valve assembly connected to the production tubing for establishing one relative pressure differential across the toroid shaped device in the production tubing to move the toroid shaped device upward within the production tubing and lift the liquid, and the valve assembly establishing an opposite relative pressure differential across the toroid shaped device in the production tubing to move the toroid shaped device downward within the production tubing after lifting the liquid.

27. An apparatus as defined in claim 26 wherein each relative pressure differential is established in part by gas at a natural formation pressure of the well.

28. An apparatus as defined in claim 26 wherein the production tubing includes perforations at the bottom of the well through which liquid from the subterranean formation flows into the production tubing.

29. An apparatus as defined in claim 26 wherein natural formation pressure flows the liquid into the production tubing, and gas at a natural formation pressure provides the energy to move the toroid shaped device upward and downward within the production tubing and to lift the liquid from the well.

30. A method of pumping liquid from a well through a production tubing that has an inner sidewall which defines an interior production chamber, comprising:

movably positioning a fluid displacement device within the production tubing;

sealing the fluid displacement device to the inner sidewall to confine the liquid to be lifted within production tubing above the fluid displacement device;

moving the fluid displacement device upward and downward within the production chamber by applying opposite relative pressure differentials across the fluid displacement device within the production tubing to move the fluid displacement device in the direction of lesser pressure; and maintaining the sealing of the fluid displacement device to the inner sidewall while moving the fluid displacement device within the production chamber by rolling a portion of the fluid displacement device in contact with the inner sidewall.

31. A method as defined in claim 30, further comprising:

substantially eliminating relative movement of the portion of the fluid displacement device and the inner sidewall during rolling the portion of the fluid displacement device in contact with the inner sidewall.

32. A method as defined in claim 31, further comprising:

compressing the portion of the fluid displacement device against the inner sidewall while rolling the portion of the fluid displacement device in contact with the inner sidewall.

33. A method as defined in claim 32, further comprising:

resiliently flexing the fluid displacement device in a direction perpendicular to the inner sidewall while rolling the portion of the fluid displacement device in contact with the inner sidewall.

34. A method as defined in claim 30, further comprising:

using as the fluid displacement device a toroid shaped structure having an exterior elastomeric skin defining a cavity within which a viscous material is confined;

contacting an outside surface of the toroid shaped structure with the inner sidewall;

contacting an inside surface of the toroid shaped structure with itself;

rolling the toroid shaped structure within the production tubing with the outside surface contacting the inner sidewall and the inside surface contacting itself; and maintaining the sealing of the fluid displacement device by contacting the outside surface of the toroid shaped structure with the inner sidewall and by contacting the inside surface of the toroid shaped structure with itself.

35. A method as defined in claim 30, wherein the well extends downward to a well bottom located within a subterranean zone which contains liquid and gas and from which natural formation pressure flows the liquid and gas into the well bottom, further comprising:

applying gas at the natural formation pressure within the production tubing to create the pressure differential for moving the fluid displacement device.

36. A method as defined in claim 35, wherein the well extends to a surface of the earth, the production tubing extends from a lower end at the well bottom to an upper end at the earth surface, and further comprising:

moving the fluid displacement device upward from a lower position at the lower end of the production tubing to an upper position at the upper end of the production tubing by applying gas at the natural formation pressure within the production tubing below the fluid displacement device.

37. A method as defined in claim 35, further comprising:

accumulating gas at the natural formation pressure at the earth surface; and moving the fluid displacement device downward from the upper end of the production tubing to the lower end of the production tubing by applying gas accumulated at the earth surface above the fluid displacement device.

38. A method as defined in claim 35, wherein the well includes a casing which extends from a lower end at the well bottom within the subterranean zone to an upper end at a surface of the earth, the production tubing extends within the casing from a lower end at the well bottom to an upper end at the earth surface, a casing chamber is defined between the casing and the production tubing, and further comprising:

communicating the production chamber with the casing chamber at the lower ends of the production tubing and the casing at the well bottom; and moving the fluid displacement device within the production tubing from pressure of the gas within the casing chamber at natural formation pressure.

39. A method as defined in claim 38, further comprising:

communicating to the upper end of the production chamber a pressure less than the natural formation pressure during upward movement of the fluid displacement device.

40. A method as defined in claim 39, further comprising:

communicating to the upper end of the production chamber the natural formation pressure during downward movement of the fluid displacement device.

41. A method as defined in claim 40, further comprising:

accumulating gas at the natural formation pressure at the earth surface; and communicating the accumulated gas to the upper end of the production chamber during downward movement of the fluid displacement device.

42. A method as defined in claim 38, further comprising: producing gas from the casing chamber upon the fluid displacement device reaching an upper position within the production tubing.

43. A method as defined in claim 38, further comprising: moving liquid at the well bottom into the production chamber above the fluid displacement device upon the fluid displacement device moving to a lower position at the lower end of the production tubing.

44. A method as defined in claim 43, further comprising: establishing pressure within the production chamber above the fluid displacement device which is less than the pressure within the casing chamber to move the liquid into the production chamber above the fluid displacement device.

45. A method as defined in claim 38, further comprising: flowing liquid and gas from the production chamber during upward movement of the fluid displacement device within the production tubing.

46. A method as defined in claim 45, further comprising: maintaining a pressure within the production chamber above the fluid displacement device which is less than the pressure within the casing chamber during upward movement of the fluid displacement device to an upper position at the upper end of the production tubing.

47. A method as defined in claim 45, further comprising: flowing the liquid and gas from the production chamber into a sales conduit during upward movement of the fluid displacement device within the production tubing.

48. A method as defined in claim 38, further comprising: producing gas from the casing chamber while the fluid displacement device is located at an upper position at the upper end of the production tubing.

49. A method as defined in claim 48, further comprising: producing gas from the casing chamber while the fluid displacement device is moving downward within the production tubing.

50. A method as defined in claim 38, further comprising: producing gas from the casing chamber while the fluid displacement device is moving downward within the production tubing.

* * * * *